US009207589B2

(12) United States Patent
Arai et al.

(10) Patent No.: US 9,207,589 B2
(45) Date of Patent: Dec. 8, 2015

(54) FIXING DEVICE AND IMAGE FORMING APPARATUS INCLUDING SAME

(71) Applicants: Yuji Arai, Kanagawa (JP); Takayuki Seki, Kanagawa (JP); Ryuuichi Mimbu, Kanagawa (JP); Shuntaro Tamaki, Kanagawa (JP); Toshihiko Shimokawa, Kanagawa (JP); Yutaka Ikebuchi, Kanagawa (JP); Shuutaroh Yuasa, Kanagawa (JP); Kazuya Saito, Kanagawa (JP); Hiroshi Yoshinaga, Chiba (JP)

(72) Inventors: Yuji Arai, Kanagawa (JP); Takayuki Seki, Kanagawa (JP); Ryuuichi Mimbu, Kanagawa (JP); Shuntaro Tamaki, Kanagawa (JP); Toshihiko Shimokawa, Kanagawa (JP); Yutaka Ikebuchi, Kanagawa (JP); Shuutaroh Yuasa, Kanagawa (JP); Kazuya Saito, Kanagawa (JP); Hiroshi Yoshinaga, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/284,360

(22) Filed: May 21, 2014

(65) Prior Publication Data

US 2014/0356038 A1 Dec. 4, 2014

(30) Foreign Application Priority Data

May 31, 2013 (JP) ..... 2013-116517

(51) Int. Cl.
*G03G 15/20* (2006.01)

(52) U.S. Cl.
CPC ..... *G03G 15/2017* (2013.01); *G03G 15/2053* (2013.01); *G03G 15/2064* (2013.01); *G03G 15/2089* (2013.01); *G03G 2215/2016* (2013.01); *G03G 2215/2032* (2013.01); *G03G 2215/2035* (2013.01)

(58) Field of Classification Search
CPC ..... G03G 15/20
USPC ..... 399/329
See application file for complete search history.

(56) References Cited

U.S. PATENT DOCUMENTS 8,351,807 B2 * 1/2013 Seki ..... 399/45
2007/0292175 A1 12/2007 Shinshi (Continued)

FOREIGN PATENT DOCUMENTS

JP 3-189674 8/1991
JP 9-244449 9/1997

(Continued)

OTHER PUBLICATIONS

U.S. Appl. No. 14/175,570, filed Feb. 7, 2014.

(Continued)

*Primary Examiner* — Clayton E Laballe
*Assistant Examiner* — Kevin Butler
(74) *Attorney, Agent, or Firm* — Duft Bornsen & Fettig LLP

(57) ABSTRACT

A fixing device includes an endless belt or a fixing belt; a pressure member to contact an outer circumferential surface of the fixing belt; a nip forming member disposed at an interior side of the fixing belt and contacting the pressure member via the fixing belt; a heat source disposed at an interior side of the fixing belt to heat the fixing belt with radiant heat, a plurality of shielding members disposed between the heat source and the fixing belt and movable between a shielding position where the shielding member shields a non-sheet passing area on the fixing belt from the radiant heat from the heat source and a retracted position; and a controller to move the plurality of shielding members between the shielding position and the retracted position at a predetermined time.

10 Claims, 25 Drawing Sheets

(56) References Cited

U.S. PATENT DOCUMENTS

| | | | | |
|---|---|---|---|---|
| 2010/0067929 | A1 | 3/2010 | Seki | |
| 2011/0274453 | A1 | 11/2011 | Shimokawa et al. | |
| 2013/0183072 | A1* | 7/2013 | Hase et al. | 399/329 |
| 2013/0209124 | A1* | 8/2013 | Saito et al. | 399/69 |
| 2014/0016972 | A1 | 1/2014 | Seshita et al. | |
| 2014/0064804 | A1* | 3/2014 | Yamaguchi et al. | 399/329 |
| 2014/0072355 | A1* | 3/2014 | Tamaki et al. | 399/329 |
| 2014/0079424 | A1 | 3/2014 | Ikebuchi et al. | |
| 2014/0079453 | A1* | 3/2014 | Arai et al. | 399/329 |
| 2014/0079455 | A1* | 3/2014 | Seki et al. | 399/329 |
| 2014/0248072 | A1* | 9/2014 | Yoshinaga et al. | 399/329 |
| 2014/0270831 | A1* | 9/2014 | Yoshinaga et al. | 399/67 |
| 2014/0270872 | A1* | 9/2014 | Tamaki et al. | 399/329 |
| 2014/0341623 | A1* | 11/2014 | Arai et al. | 399/329 |
| 2014/0356038 | A1* | 12/2014 | Arai et al. | 399/329 |

FOREIGN PATENT DOCUMENTS

| | | | | |
|---|---|---|---|---|
| JP | 10-282823 | | 10/1998 | |
| JP | 2004-252137 | | 9/2004 | |
| JP | 2004-286922 | | 10/2004 | |
| JP | 2005056595 | A | 3/2005 | |
| JP | 2007-334205 | | 12/2007 | |
| JP | 2009008762 | | 1/2009 | |
| JP | 2010-032625 | * | 2/2010 | G03G 15/20 |
| JP | 2010-079309 | | 4/2010 | |

OTHER PUBLICATIONS

U.S. Appl. No. 14/161,662, filed Jan. 22, 2014.
U.S. Appl. No. 14/141,351, filed Dec. 26, 2013.
U.S. Appl. No. 14/190,048, filed Feb. 25, 2014.
U.S. Appl. No. 14/141,334, filed Dec. 26, 2013.
U.S. Appl. No. 14/143,253, filed Dec. 30, 2013.
U.S. Appl. No. 14/193,273, filed Feb. 28, 2014.

* cited by examiner

FIXING DEVICE AND IMAGE FORMING APPARATUS INCLUDING SAME

CROSS-REFERENCE TO RELATED APPLICATION

The present application claims priority pursuant to 35 U.S.C. §119(a) from Japanese patent application number 2013-116517, filed on May 31, 2013, the entire disclosure of which is incorporated by reference herein.

BACKGROUND

1. Technical Field

Exemplary aspects of the present disclosure relate to a fixing device for use in an image forming apparatus such as a printer, a facsimile machine, a copier, and the like, and further to the image forming apparatus including such a fixing device.

2. Related Art

For fixing devices employed in image forming apparatuses a thin-layered fixing belt formed of a metal base and a resin rubber layer deposited on the metal base is known. Use of such a thin-layered fixing belt with a low thermal capacity can drastically reduce the power necessary for heating the fixing belt and warm-up time or a first print time. The first print time is the time required from receipt of a print request to a completion of a printing operation and a sheet discharge.

For example, a fixing device includes an endless fixing belt and a pressure roller. The pressure roller contacts an outer circumference of the fixing belt. A nip-forming member is disposed at an inner circumference of the fixing belt that presses against the inner surface of the belt to form a nip portion with the pressure roller, with the fixing belt in between.

A heat source to heat the fixing belt with radiant heat is disposed at an interior side of the fixing belt. In this case, because the endless belt can be directly heated by the heat source where the nip-forming member is not disposed, heating efficiency is drastically improved and energy consumption is reduced, so that the first-print time from standby is further shortened.

When a sheet of paper passes through the nip portion of the fixing device, because the fixing belt and the sheet contact each other, the heat of the fixing belt is absorbed by the sheet. On the other hand, since the fixing belt is wider than the sheet, beyond the margins of the sheet, the fixing belt and the sheet do not contact each other and the heat is not absorbed by the sheet. As a result, when a number of sheets are conveyed continuously, heat accumulates in this so-called non-sheet passing area, degrading the fixing belt.

The fixing device includes a shielding member that shields radiant heat from the heat source, disposed between the heat source and the fixing belt at both lateral sides the fixing belt. With this structure, an excess temperature rise of the fixing belt in the non-sheet passing area thereof is prevented, and the degradation of the fixing belt due to the excess heat is prevented.

However, because the heat-shielding member itself is heated by the radiant heat from the heat source, the shielding member tends to get overheated during the continuous printing of the number of sheets, resulting in deformation of the shielding member due to the excess heat. Such deformation of the shielding member may cause degradation of the function of the shielding member or interference of the deformed portion of the shielding member with another part or component.

SUMMARY

In one embodiment of this disclosure, there is provided an improved fixing device that includes an endless belt; a pressure member to contact an outer circumferential surface of the endless belt; a nip forming member disposed at an interior side of the belt and contacting the pressure member via the belt, to thus form a nip portion; a heat source disposed at an interior side of the belt to heat the belt with radiant heat, in which a recording medium is conveyed through the nip portion to fuse an image onto the recording medium. The fixing device further includes a plurality of shielding members disposed between the heat source and the belt and movable between a shielding position where the shielding member shields a non-sheet passing area on the belt from the radiant heat from the heat source and a retracted position where the shielding member is retracted from the shielding position; and a control circuit to control operation of each shielding member such that each position of the plurality of shielding members is switched at a predetermined timing between the shielding position and the retracted position.

These and other objects, features, and advantages of the present invention will become apparent upon consideration of the following description of the preferred embodiments of the present invention when taken in conjunction with the accompanying drawings.

DETAILED DESCRIPTION

[First Embodiment]

Figure 1:
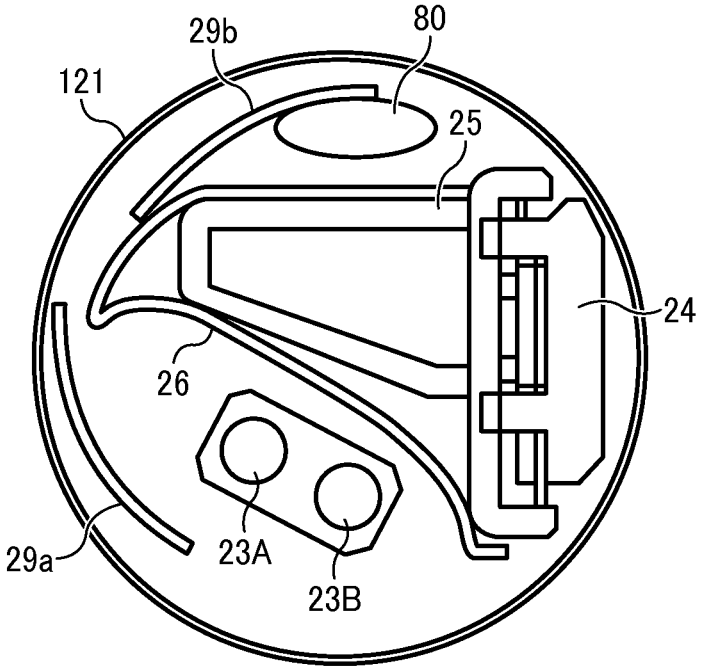
FIG. 1 illustrates a fixing device including two shielding members therein, in which one of the two shielding members is positioned at a shielding position and the other at a retracted position.

Hereinafter, referring to the accompanying drawings, a first embodiment of the present invention will be described. In each figure illustrating the first embodiment of the present invention, a part or component having the same function or shape is applied with the same reference numeral, and once explained, a redundant description thereof will be omitted.

Figure 2:
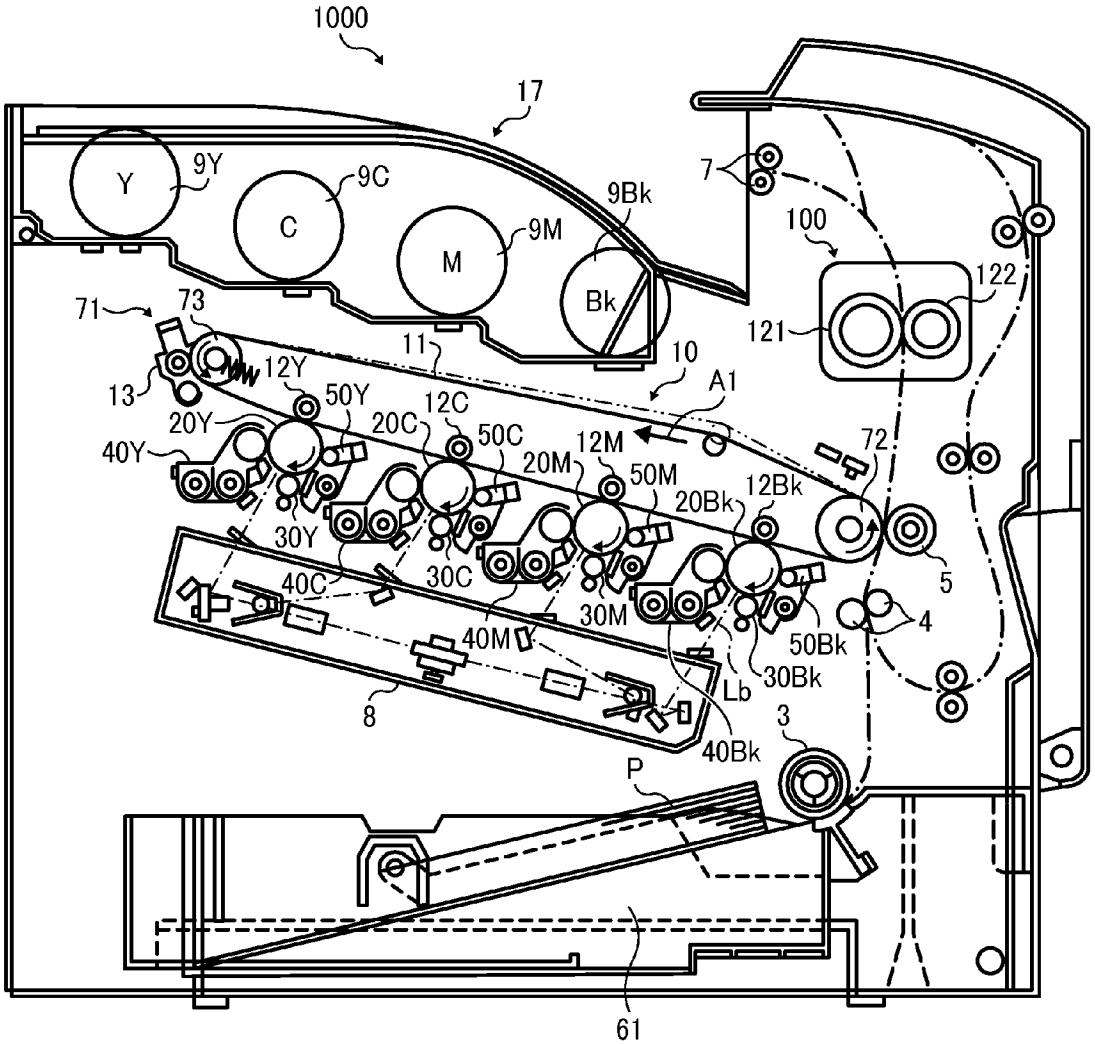
FIG. 2 illustrates a schematic configuration of an image forming apparatus according to an embodiment of the present invention.

FIG. 2 illustrates a schematic configuration of an image forming apparatus 1000 according to the first embodiment of the present invention.

As illustrated in FIG. 2, the image forming apparatus 1000 is a color laser printer employing a tandem arrangement of photoconductors and includes an image forming station formed of four image-forming units in the center of the apparatus.

The multiple image forming units are disposed along an endless-belt-shaped intermediate transfer belt 11. Each of the image forming units has the same structure except that each includes a different color of developer, such as yellow (Y), magenta (M), cyan (C), and black (Bk) that corresponds to RGB color separation component of a color image.

As illustrated in FIG. 2, the image forming apparatus 1000 includes photoreceptor drums 20Y, 20C, 20M, and 20Bk each as an image carrier to form an image of a color corresponding to a color decomposed from a print-target image into each color of yellow, cyan, magenta, and black.

Each visible toner image formed on each photoreceptor drum 20Y, 20C, 20M, or 20Bk is primarily superimposed on an intermediate transfer belt 11 movable in Arrow Direction A1 opposite each photoreceptor drum. With this operation, a full color toner image is formed on the intermediate transfer belt 11. Each color toner image transferred sequentially in a superimposed manner to the intermediate transfer belt 11 is then secondarily transferred en bloc to a recording medium P as a secondary transfer process.

Various devices to perform respective imaging process according to a rotation of the photoreceptor drum 20 are disposed around each photoreceptor drum 20Y, 20C, 20M, or 20Bk.

A structure of the photoreceptor drum 20Bk that performs image formation of black images will be described as a representative example.

Along the rotation direction of the photoreceptor drum 20Bk, a charger 30Bk, a developing device 40Bk, a primary transfer roller 12Bk, and a cleaning device 50Bk are disposed. An optical write unit 8 is an exposure means to expose a surface of the photoreceptor drum 20Bk. The optical write unit 8 exposes the surface of the photoreceptor drum Bk to write an electrostatic latent image thereon.

The optical write unit 8 includes a semiconductor laser as a light source, a coupling lens, an fθ lens, a toroidal lens, a folding mirror, and a polygon mirror as a deflection means. The optical write unit 8 emits a writing laser beam Lb based on image data onto a surface of each photoreceptor drum 20Y, 20C, 20M, or 20Bk and forms an electrostatic latent image on each photoreceptor drum 20Y, 20C, 20M, or 20Bk.

Each visible image (toner image) formed on each photoreceptor drum 20Y, 20C, 20M, and 20Bk is transferred to the intermediate transfer belt 11 to be superimposed on the same position on the intermediate transfer belt 11 while the intermediate transfer belt 11 is moving in Direction A1 in FIG. 2.

More specifically, the primary transfer bias is applied to each of the plurality of primary transfer rollers 12Y, 12C, 12M, and 12Bk disposed opposite each photoreceptor drum 20Y, 20C, 20M, and 20Bk with the intermediate transfer belt 11 sandwiched in between. The toner image formed on each photoreceptor drum 20Y, 20C, 20M, or 20Bk is transferred in the superimposed manner in the rotation direction of the intermediate transfer belt via the primary transfer rollers 12Y, 12C, 12M, and 12Bk to which the primary transfer bias is applied.

The four primary transfer rollers 12Y, 12C, 12M, and 12Bk each are disposed at a position opposed to a corresponding one of the photoreceptor drums 20Y, 20C, 20M, and 20Bk with the intermediate transfer belt 11 sandwiched in between, thereby forming a primary transfer nip. Each primary transfer roller 12Y, 12C, 12M, or 12Bk is connected to a power source, not shown. Each primary transfer roller 12Y, 12C, 12M, or 12Bk is supplied with a primary transfer bias of either a predetermined direct current voltage (DC) or alternating current voltage (AC).

Each photoreceptor drum 20Y, 20C, 20M, or 20Bk is disposed, in that order, from upstream to downstream in Direction A1. Each photoreceptor drum 20Y, 20C, 20M, or 20Bk is mounted in a corresponding image forming unit that forms images of each color of yellow, cyan, magenta, and black.

The image forming apparatus 1000 further includes, other than the plurality of image forming units, a transfer belt unit 10, a secondary transfer roller 5, a transfer belt-cleaning device 13, and the optical write unit 8.

The transfer belt unit 10 includes, other than the intermediate transfer belt 11 and the plurality of primary transfer rollers 12Y, 12C, 12M, and 12Bk, a drive roller 72 and a driven roller 73 around both of which the intermediate transfer belt 11 is stretched. When the drive roller 72 rotates in the clockwise direction as shown in the figure, the intermediate transfer belt 11 is driven to rotate in a direction as indicated by Arrow A1 in the figure.

The drive roller 72 also functions as a secondary transfer backup roller opposed to the secondary transfer roller 5 via the intermediate transfer belt 11. The drive roller 73 also functions as a cleaning backup roller opposed to the transfer belt-cleaning device 13 via the intermediate transfer belt 11. The driven roller 73 serves as a biasing member pressing against the intermediate transfer belt 11. Thus, the driven roller 73 is provided with a biasing means such as a spring. The transfer device 71 is thus constructed of the transfer belt unit 10, the primary transfer rollers 12Y, 12C, 12M, and 12Bk, the secondary transfer roller 5, and the transfer belt-cleaning device 13.

The secondary transfer roller 5 is disposed opposite the intermediate transfer belt 11 and is driven to rotate by the intermediate transfer belt 11. The secondary transfer roller 5 sandwiches the intermediate transfer belt 11 together with the drive roller 72 that serves as a secondary transfer backup roller to thus from a secondary transfer nip.

In addition, similar to the primary transfer rollers 12Y, 12C, 12M, and 12Bk, the secondary transfer roller 5 is connected to a power source, not shown, and a secondary transfer bias of either predetermined direct current (DC) voltage or alternating current (AC) voltage is applied to the secondary transfer roller 5.

The transfer belt-cleaning device 13 is disposed opposite the driven roller 73 via the intermediate transfer belt 11, so that the transfer belt-cleaning device 13 cleans the surface of the intermediate transfer belt 11. The belt-cleaning device 13 includes a cleaning brush and a cleaning blade, which are so disposed as to contact the intermediate transfer belt 11. A waste toner conveying hose, not shown, extends from the belt-cleaning device 13 and is connected with an inlet port of the waste toner container, not shown.

The image forming apparatus 1000 further includes a sheet feeder 61 on which the plural sheets P as recording media are stacked, a registration roller pair as a means to feed the recording media, and a sheet leading end sensor (not shown) that serves as a means to detect a leading end of the recording media.

The sheet feeder 61 disposed in the bottom of the image forming apparatus 1000 includes a sheet feed roller 3 that contacts an upper surface of the topmost recording sheet P. When the sheet feed roller 3 rotates in the counterclockwise direction, the topmost recording sheet P is conveyed to the registration roller pair 4.

Further, a conveyance path through which the sheet P is conveyed from the sheet feeder 61 to an outside of the printer via the secondary transfer nip is defined by various components inside the image forming apparatus. A registration roller pair 4 is disposed upstream of the secondary transfer roller 5 in the sheet conveyance direction. The registration roller pair 4 serves as a conveyance means to convey the sheet P to the secondary transfer nip.

The recording sheet P conveyed from the sheet feeder 61 is sent, via the registration roller pair 4, to the secondary transfer nip between the secondary transfer roller 5 and the intermediate transfer belt 11 at a predetermined timing adjusted to the timing that the image station formed of the plurality of image forming units forms the toner image. The leading end sensor detects that the leading end of the recording sheet P arrives at the registration roller pair 4.

Herein, in addition to an ordinary sheet, the recording media include various sheets such as a cardboard, a postcard, an envelope, thin paper, coated paper or art paper, tracing paper, an OHP sheet, and the like. In addition, other than the sheet feeder 61, a manual sheet feeder that can supply a sheet P manually may be disposed in the image forming apparatus.

The image forming apparatus 1000 further includes a fixing device 100 that fixes the toner image transferred and carried on the sheet P, a sheet discharge roller pair 7 that serves as a recording medium discharging means, and a sheet discharge tray 17 as a recording medium stacking means. The sheet discharge roller pair 7 discharges the sheet P on which the image is fixed to outside the body of the image forming apparatus 1000. The sheet discharge tray 17 disposed above the image forming apparatus 1000 contains the sheet P thus discharged by the sheet discharge roller pair 7.

The image forming apparatus 1000 further includes toner bottles 9Y, 9C, 9M, and 9Bk. The multiple toner bottles 9Y, 9C, 9M, and 9Bk each containing toner of one of colors, i.e., yellow, cyan, magenta, and black are detachably disposed at an upper part of the image forming apparatus and below the sheet discharge tray 17.

A supply path, not shown, to connect each toner bottle 9Y, 9C, 9M, or 9Bk and each developing device 40Y, 40C, 40M, or 40Bk is provided. Toner is supplied from each toner bottle 9Y, 9C, 9M, or 9Bk to a corresponding developing device 40Y, 40C, 40M, and 40Bk via the supply path.

The transfer belt-cleaning device 13 disposed in the transfer device 71 includes a cleaning brush and a cleaning blade, both of which are disposed to contact the intermediate transfer belt 11.

The cleaning brush and the cleaning blade of the intermediate transfer belt-cleaning device 11 scrape and remove foreign particles such as residual toner remaining on the intermediate transfer belt 11 and the intermediate transfer belt 11 is cleaned. The transfer belt-cleaning device 13 also includes a discharging means, not shown, to collect the residual toner removed from the intermediate transfer belt 11.

Next, basic operation of the image forming apparatus 1000 will be described with reference to FIG. 2.

When an image forming operation is started in the image forming apparatus 1000, each photoreceptor drum 20Y, 20C, 20M, or 20Bk of each of the image forming units is driven by a driving device, not shown, to rotate in the clockwise direction as illustrated in FIG. 2. Each surface of the photoreceptor drum 20Y, 20C, 20M, or 20Bk is uniformly charged at a predetermined polarity by the charger 30Y, 30C, 30M, or 30Bk, respectively.

The optical write unit 8 radiates laser beams onto the charged surface of each photoreceptor drum 20Y, 20C, 20M, or 20Bk and an electrostatic latent image is formed on the surface of each photoreceptor drum 20Y, 20C, 20M, or 20Bk. In this case, the image data exposed on each photoreceptor drum 20Y, 20C, 20M, or 20Bk is monochrome image data decomposed, from the target full-color image, into color data of yellow, magenta, cyan, and black.

Each developing device 40Y, 40C, 40M, or 40Bk supplies toner to the electrostatic latent image formed on each photoreceptor drum 20Y, 20C, 20M, or 20Bk, and the electrostatic latent image is rendered visible as a toner image.

When the image forming operation is started, the drive roller 72 rotates in the counterclockwise direction as illustrated in FIG. 2, and the intermediate transfer belt 11 is driven to rotate in the direction of arrow A1 in the figure. Then, a constant voltage or constant-current controlled voltage having an opposite polarity to the polarity of the charged toner is applied to each primary transfer roller 12Y, 12C, 12M, or 12Bk. According to this, a predetermined transfer electric field is formed at a primary transfer nip between each primary transfer roller 12Y, 12C, 12M, or 12Bk and each photoreceptor drum 20Y, 20C, 20M, or 20Bk.

Thereafter, the toner image of each color formed on each photoreceptor drum 20Y, 20C, 20M, or 20Bk is sequentially transferred and superimposed on the intermediate transfer belt 11 by the transfer electric field formed in the primary transfer nip, so that a full-color toner image is carried on the surface of the intermediate transfer belt 11.

In addition, the residual toner, which has not been transferred to the intermediate transfer belt 11, is removed by the cleaning device 50Y, 50C, 50M, or 50Bk. Thereafter, the surface of each photoreceptor drum 20Y, 20C, 20M, or 20Bk is electrically discharged by a discharger, not shown, and the surface potential is initialized.

The sheet feed roller 3 disposed in the bottom of the image forming apparatus 1000 starts to rotate so that the sheet P is fed out from the sheet feeder 61 to the conveyance path. The sheet P conveyed to the conveyance path P is sent to the secondary transfer nip between the secondary transfer roller 5 that serves as a secondary transfer backup roller, and the secondary transfer roller 5 at a timing defined by the registration roller pair 4. In this case, because the transfer voltage having a polarity opposite that of the charged toner of the toner image on the intermediate transfer belt 11 is applied to the secondary transfer roller 5, a predetermined transfer electric field is formed at the secondary transfer nip.

Thereafter, upon the toner image formed on the intermediate transfer belt 11 reaches the secondary transfer nip associated with the rotation of the intermediate transfer belt 11, the toner image on the intermediate transfer belt 11 is transferred en bloc onto the sheet P via the transfer electric field generated in the secondary transfer nip.

In addition, the residual toner that has not been transferred to the intermediate transfer belt 11 and remains on the intermediate transfer belt 11 is removed by the belt-cleaning device 13 and is conveyed to and collected in a waste toner container, not shown.

Thereafter, the sheet P is conveyed to the fixing device 100, and the toner image on the sheet P is fixed by the fixing device 100 onto the sheet P. The sheet P is then discharged outside the apparatus 1000 by the sheet discharge roller pair 7, and is stacked on the sheet discharge tray 17.

The description heretofore relates to an image forming operation when a full-color image is formed on the sheet; however, a monochrome image may be formed using any one of the four image forming units and an image using two or three colors may be possible by using two or three image forming units.

In an image forming apparatus employing an electrophotographic method, a copied image is output through a process in which an electrostatic latent image formed on the photoreceptor, as a latent image carrier, is rendered visible with toner and the toner image is then transferred onto a recording medium such as a sheet and is fixed thereon, for output.

Fixing methods used for the image forming apparatus include heat roller fusing, belt-fusing, film-fusing, and induction heating fusing.

The heat roller fusing method employs a fixing device roller and a pressure roller that are disposed opposite and contacting each other along the conveyance path of the recording medium. In this method, the toner image is fused and forced into the sheet via the heat from the heat source disposed inside the fusing roller and a biasing force from the pressure roller. The phenomenon in which the toner image is fused and forced into the sheet is apparent in the fusing method including following structures.

In the belt fusing method, instead of the fusing roller, a fixing belt as a good thermal conductor, the pressure roller, a roller that is wound by the belt and a heat source to heat the belt are used (see JP-2004-286922-A).

In the film fusing method, instead of the fusing roller, a fixing belt as a good thermal conductor, the pressure roller, a roller that is wound by the belt and a heat source to heat the belt are used (see JP-2010-079309-A).

In the induction heating fusing method, an induction-heating coil that improves heating efficiency is used for the heating member (see, for example, JP-2004-286922-A).

Fusing methods preferably shorten the warm-up time and the first print time. The fixing device happens to generate defective fusing due to the following reasons.

High-speed printing enables the number of sheets to be fused per unit time to be increased, that is, the number of prints that pass through the fixing device increases. For this reason, the amount of heat to be supplied to each sheet needs to be increased in order to supply the amount of heat necessary to fuse the image onto the sheet in the shortened time while the sheet passes through the fixing device.

However, if a necessary amount of heat is not prepared at a time of initiation of the continuous printing, the temperature of the fixing device falls, so that the amount of the heat necessary to the high-speed continuous printing is not obtained, thereby causing defective fusing to occur.

In addition, in accordance with the higher printing speed of the image forming apparatus, the number of prints per unit time increases and a required heat amount drastically increases. In particular, upon the start of continuous printing, thermal capacity tends to be insufficient and a so-called temperature drop occurs, which causes defective fusing to occur.

On the other hand, other than the fusing method as described above, there is a method called SURF fusing a ceramic heater. SURF fusing method locally heats a nip portion alone and leaves other parts unheated. In this fusing method, compared to the belt fusing method, low thermal capacity and a compact apparatus are enabled, so that a quick rise time and reduction in the first print time can be achieved. However, there is a drawback in that, because the SURF fusing method locally heats a nip portion alone, the fixing belt is coolest at an inlet to the nip portion and defective fusing may occur. In particular, in the high-speed apparatus in which the belt rotates fast and heat is discharged from portions other than the nip, defective fusing tends to occur more frequently.

To solve such a problem, JP-2007-334205-A proposes a structure to use a fixing belt, in which an optimal fixability is obtained even though mounted in a high-performance apparatus.

Figure 3:
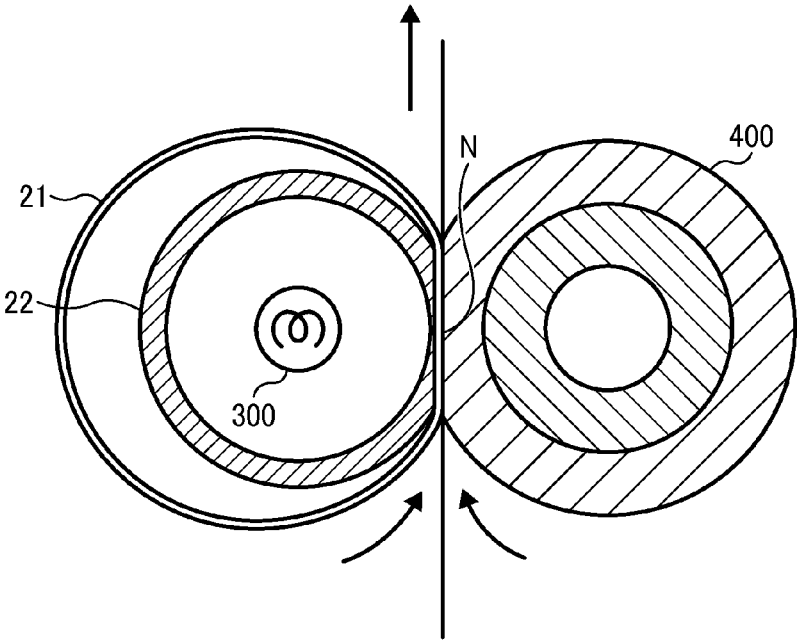
FIG. 3 BACKGROUND ART
FIG. 3 illustrates a conventional fixing device configured to heat the fixing belt indirectly via a thermal conductor formed of a metal.

The fixing device disclosed in JP-2007-334205-A employs a structure as illustrated in FIG. 3 and includes a fixing belt 21, a pipe-shaped metallic thermal conductor 22 disposed inside the fixing belt 21, a heat source 300 disposed inside the metallic thermal conductor 22, and a pressure roller 400. The pressure roller 400 contacts the metallic thermal conductor 22 via the fixing belt 21, thereby forming a nip portion N at the contacted portion.

The fixing belt 21 rotates associated with the rotation of the pressure roller 400, and the metallic thermal conductor 22 guides the movement of the fixing belt 21. In addition, the heat source 300 inside the metallic thermal conductor 22 heats the fixing belt 21 via the metallic thermal conductor 22, to thus heat the fixing belt 21 entirely. With this structure, the first print time from standby can be shortened and the heat shortage in the high-speed printing can be removed.

However, to further save energy and shorten the first-print time, the thermal efficiency should be improved more.

Thus, instead of heating indirectly the fixing belt 21 via the metallic thermal conductor 22 as illustrated in FIG. 3, if a structure to directly heat the fixing belt is adopted, energy consumption can be reduced and the first-print time from standby is further shortened. In addition, because the metallic thermal conductor is not provided, a cost reduction is achieved.

Figure 4:
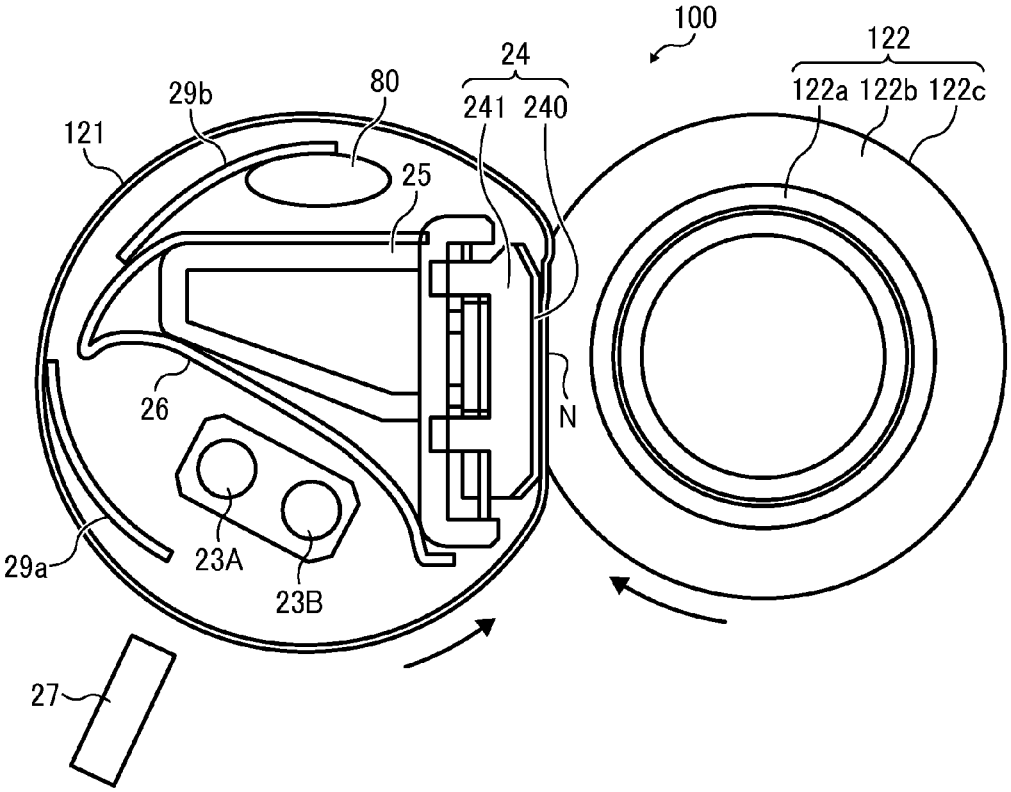
FIG. 4 is a cross-sectional view of a fixing device according to the embodiment of the present invention.

Next, with reference to FIG. 4, a schematic configuration of the fixing device 100 according to the present embodiment will be described. FIG. 4 is a cross-sectional view of the fixing device 100 according to the embodiment of the present invention.

The fixing device 100 includes a fixing belt 121 and a pressure roller 122. The fixing belt 121 is hollow. The pressure roller 122 is rotatably disposed opposite the fixing belt 121.

The fixing belt 121 further includes, in an interior thereof, halogen heaters 23A and 23B to heat the fixing belt 121; and a nip-forming member 24 to form a nip portion N together with the pressure roller 122 opposed to the nip-forming member 24 via the fixing belt 121. Further, inside the fixing belt 121, disposed are a stay 25 as a member to support the nip-forming member 24, and a reflecting member 26 to reflect the light radiated from the halogen heaters 23A and 23B to the fixing belt 121.

In addition, a temperature sensor 27 and a pressurizing member are provided. The temperature sensor 27 is disposed opposite an outer surface of the fixing belt 121 and detects a temperature of the fixing belt 121. The pressurizing member presses the pressure roller 122 against the fixing belt 121.

Flanges, not shown, are disposed at both ends of the fixing belt 121 in the width direction thereof, to rotatably support the fixing belt 121. The halogen heaters 23A and 23B, the stay 25, and flanges are fixed to a pair of side plates, not shown, of the fixing device 100.

Preferred materials for the fixing belt 121 include a thin, flexible endless belt material or film. The fixing belt 121 includes a base formed of metallic materials such as nickel or SUS or of resin materials such as polyimide (PI). The fixing belt 121 further includes a release layer on the base and formed of copolymer of tetrafluoroethylene-perfluoroalkyl vinylether (PFA) or polytetrafluoroethylene (PTFE). In addition, optionally an elastic layer formed of silicon rubber may be disposed between the base and the release layer. Without the release layer, the thermal capacity of the pressure roller 122 is reduced, thereby improving the fixability. However, when the unfixed toner is pressed and fused, minute irregularities in the belt surface is transferred to the image and the solid image portion may include orange-peel-like uneven traces. To remedy such uneven trace in the formed image, the elastic layer with a thickness of 100 μm or more is desired that may absorb the minute concavity and convexity of the belt surface due to the elastic deformation of the elastic layer, thereby preventing the orange-peel-like uneven traces in the solid portion of the image.

The pressure roller 122 includes a metal core 122*a*, an elastic layer 122*b*, and a release layer 122*c*. The elastic layer 122*b* formed of foamable silicon rubber, silicon rubber, or fluoro-rubber, is disposed on the surface of the metal core 122*a*. The release layer 122*c* is disposed on the surface of the elastic layer 122*b* and is formed of PFA or PTFE.

The pressure roller 122 is pressed toward the fixing belt 121 via a spring, not shown, as a biasing member, so that the pressure roller 122 contacts the nip-forming member 24 via the fixing belt 121. The elastic layer 122*b* of the pressure roller 122 squeezes where the pressure roller 122 and the fixing belt 121 press against each other, thereby forming a nip portion N of a predetermined extent or width.

The pressure roller 122 is configured to rotate by a driving source such as a motor, not shown, disposed in the body of the image forming apparatus. When the pressure roller 122 is driven to rotate, the driving force is transmitted to the fixing belt 121 at the nip portion N, so that the fixing belt 121 is driven to rotate.

In the present embodiment, the pressure roller 122 is configured as a solid-core roller, but may be a hollow roller. When the pressure roller 122 is a hollow roller, a heat source such as a halogen heater may be disposed inside the pressure roller 122.

The elastic layer 122*b* may be formed of a solid rubber but may use a sponge rubber when the pressure roller 122 does not include a built-in heater. Because the sponge rubber has a higher heat shielding property and prevents heat of the fixing belt 121 from being absorbed, the sponge rubber is more preferable. In addition, although in the present embodiment the fixing belt 121 and the pressure roller 122 press against each other, they may be configured to just contact each other without pressure.

As illustrated in FIG. 4, the fixing device 100 is configured to directly heat the fixing belt 121 by the radiant heat from the halogen heaters 23A and 23B and includes two halogen heaters 23A and 23B, as heat sources, disposed in an interior of the fixing belt 121. Each halogen heater 23A or 23B includes a different heating area. Because each halogen heater 23A or 23B has a heating area different from each other, the fixing belt 121 can be heated in varied ranges corresponding to various sheet width sizes.

The halogen heaters 23A and 23B are supplied with electric power by the power source serving as an electric power supplying means and the output thereof is controlled by the heat source.

Control of the output from the halogen heaters 23A and 23B is performed by controlling the on/off time or the supplied amount of electricity of the halogen heaters 23A and 23B based on the detection result of the surface temperature of the fixing belt 121 by the temperature sensor 27. The temperature of the fixing belt 121 can be set at a desired level for fusing via such an output control of the halogen heaters 23A and 23B.

Induction heating (IH) heater, resistance heat generator, ceramic heater, carbon heater, and the like may be used as a heat source to heat the fixing belt 121 other than the halogen heater.

In addition, in the place of the temperature sensor to detect temperature of the fixing belt 121, a temperature sensor to detect the pressure roller 122 may be disposed, so that the temperature of the fixing belt 121 can be calculated from the temperature detected by the sensor.

The nip-forming member 24 includes a base pad 241, a friction sheet 240 having a low frictional force disposed on a surface of the base pad 241 opposite the fixing belt 121. The base pad 241 is disposed longitudinally along the axial direction of the fixing belt 121 or the axial direction of the pressure roller 122.

The base pad 241 receives a pressure from the pressure roller 122, so that the shape of the nip portion N is defined. In the present embodiment, the shape of the nip portion N is planar, but may be convex or may have another shape. A convex shape of the nip portion N minimizes the occurrence of paper jams because a leading end of the recording sheet when discharged from the nip comes nearer to the pressure roller 122 and separability of the sheet is improved.

The friction sheet 240 is disposed to lower a sliding friction when the fixing belt 121 rotates. If the base pad 241 itself is formed of a low-friction material, the friction sheet 240 may be dispensed with.

Because the base pad 241 is formed of heat-resistant materials capable of withstanding temperatures of 200 degrees C. or more, the base pad 241 prevents deformation of the nip-forming member 24 due to heat in the toner fusing temperature area, secures a stable state of the nip portion N, and stabilizes the output image.

Exemplary materials for the base pad 241 include common heat-resistant resins such as polyethersulfone (PES), polyphenilene sulfide (PPS), liquid crystal polymer (LCP), polyethernitrile (PEN), polyamideimide (PAI), and polyetheretherketone (PEEK).

Further, the base pad 241 is fixed to and is supported by the stay 25. With this structure, bending of the nip-forming member 24 due to the pressure from the pressure roller 122 may be prevented from occurring and a uniform nip width may be obtained along the axial direction of the pressure roller 122.

It is preferred that the stay 25 be formed of a metal material having high mechanical strength such as stainless steel or iron so as to prevent the nip-forming member 24 from bending. In addition, the base pad 241 is also preferably formed of a material having a certain stiffness to secure the strength. Examples of the materials for the base pad 241 include resins such as liquid crystal polymer (LCP), metals, or ceramics.

The reflecting member 26 fixed to and supported by the stay 25 is disposed opposite the halogen heaters 23A and 23B. Heat or light irradiated from the halogen heaters 23A and 23B is reflected to the fixing belt 121 by the reflecting member 26. With this structure, heat radiated from the halogen heaters 23A and 23B is prevented from being transmitted to the stay 25 and the like, so that the fixing belt 121 can be heated effectively and useless energy consumption can be suppressed.

Examples of materials for the reflecting member 26 include aluminum or stainless steel. In particular, if aluminum base on which low-radiation-factor silver is vapor-deposited is used, heat efficiency of the fixing belt 121 can be improved. Specifically, at least a surface of the reflecting member 26 opposite the halogen heaters 23A and 23B is formed of materials such as aluminum or silver with high heat reflectivity, so that the heat from the halogen heaters 23A and 23B is effectively reflected to the fixing belt 121, to thus improve heating efficiency.

In addition, without providing the reflecting member 26, the surface of the stay 25 opposite the halogen heaters 23A and 23B is subjected to mirror-like finishing via polishing or coating and a reflection surface can be formed.

However, to secure the rigidity, the shape or material for the stay 25 should be considered carefully. Thus, providing the reflecting member 26 separately widens options for selecting a shape and material, and the reflecting member 26 and the stay 25 each may have a specialized feature.

In addition, because the reflecting member 26 is disposed between the halogen heaters 23A and 23B and the stay 25, the reflecting member 26 is positioned near the halogen heaters 23A and 23B, so that the fixing belt 121 can be heated efficiently.

Shielding members 29*a*, 29*b* are disposed between the fixing belt 121 and the halogen heaters 23A and 23B. The shielding members are movable between a shielding position where the radiant heat from the halogen heaters 23A and 23B to the non-sheet passing area of the fixing belt 121 is shielded and a retracted position retracted from the shielding position. With this structure, excessive temperature rise in the non-sheet passing area of the fixing belt 121 can be suppressed, thereby preventing deterioration and damage of the fixing belt 121 due to the heat.

In addition, as illustrated in FIG. 4, the position where the shielding member 29*a* is positioned is the shielding position and the position where the shielding member 29*b* is positioned is the retracted position. In addition, if either the shielding member 29*a* or the shielding member 29*b* is not designated in particular, it is collectively defined as the shielding member 29.

The shielding members 29*a*, 29*b* are constructed of sheet metal having a thickness of 0.1 mm to 1.0 mm to include an arc-shaped cross section along an inner circumferential surface of the fixing belt 121. Further, the shielding member 29 is movable along the circumference of the fixing belt 121.

In the present embodiment, there is an area along the circumference of the fixing belt 121 where the halogen heater 23 is positioned opposite the fixing belt 121 and directly heats the fixing belt 121, that is, a direct heating area. In addition, there is an area where the halogen heater 23 indirectly heats the fixing belt 121 because members such as the stay 25, the nip-forming member 24, and the reflecting member 26 other than the shielding member 29 are interpolated between the halogen heater 23 and the fixing belt 121, that is, an indirect heating area.

When the heat needs to be shielded, the shielding member 29 is moved to a shielding position in the direct heating area. On the other hand, when the heat need not be shielded, the shielding member 29 is retracted from the shielding position to the retracted position, that is, to a rear side of the reflecting member 26 or the stay 25.

Because the shielding member 29 requires heat resistance, preferred materials for the shielding member 29 are metals such as iron and stainless steel capable of withstanding temperatures of more than 350 degrees C. Further, at least a surface of the shielding member 29 opposite the halogen heaters 23A and 23B is formed of materials with lower heat reflectivity than that of the surface of the reflecting member 26 opposite the halogen heaters 23A and 23B. With such a structure, a localized excessive temperature rise in the reflecting member 26 due to the reflection of light from the shielding member 29 may be minimized.

In addition, the shielding member 29 is preferably formed of a material with high heat conductivity. With such a structure, a localized excessive temperature rise in the shielding member 29 may be minimized. In addition, provision of the high heat conductivity layer to the shielding member 29 effectively prevents the localized excessive temperature rise thereof. Preferred materials for the heat conductivity layer to be provided to the shielding member 29 are metals including copper, aluminum, and nickel.

In the present embodiment, to change the heating area in accordance with the sheet size, the heat generators of the halogen heaters 23A and 23B have different lengths and positions. More specifically, the heat generator of the halogen heater 23A is disposed in the center in the longitudinal direction thereof and the heat generator of the halogen heater 23B is disposed at both ends in the longitudinal direction.

The heat generator of the halogen heater 23A is disposed to deal with an area more than the sheet width W1 for a small-size sheet and less than the sheet width W2 for a medium-size sheet. Further, the heat generator of the halogen heater 23B is disposed to deal with an area more than the sheet width W2 for the medium-size sheet and including the sheet width W3 for the large-size sheet.

Figure 5:
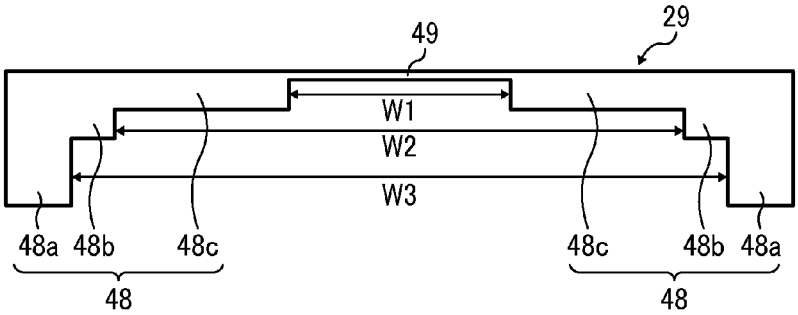
FIG. 5 is a plan view illustrating a construction of the shielding member.

FIG. 5 is a plan view illustrating a construction of the shielding member 29. As illustrated in FIG. 5, the shielding member 29 includes shielding sections 48*a* to 48*c* disposed at both ends thereof; each shielding part 48 is configured to have three steps. Specifically, each shielding part 48 includes a first shielding section 48*a*, a second shielding section 48*b*, and a third shielding section 48*c*. In addition, the third shielding sections 48*c* of the shielding parts 48 are connected to each other via a connecting portion 49.

As illustrated in FIG. 5, the shielding member 29 handles at least three sizes of sheet, including a small-size sheet such as a postcard, a medium-size sheet such as a B4-size sheet, and a large-size sheet such as an A3-size sheet. However, the sizes of the sheet are not limited thereto.

Figure 6:
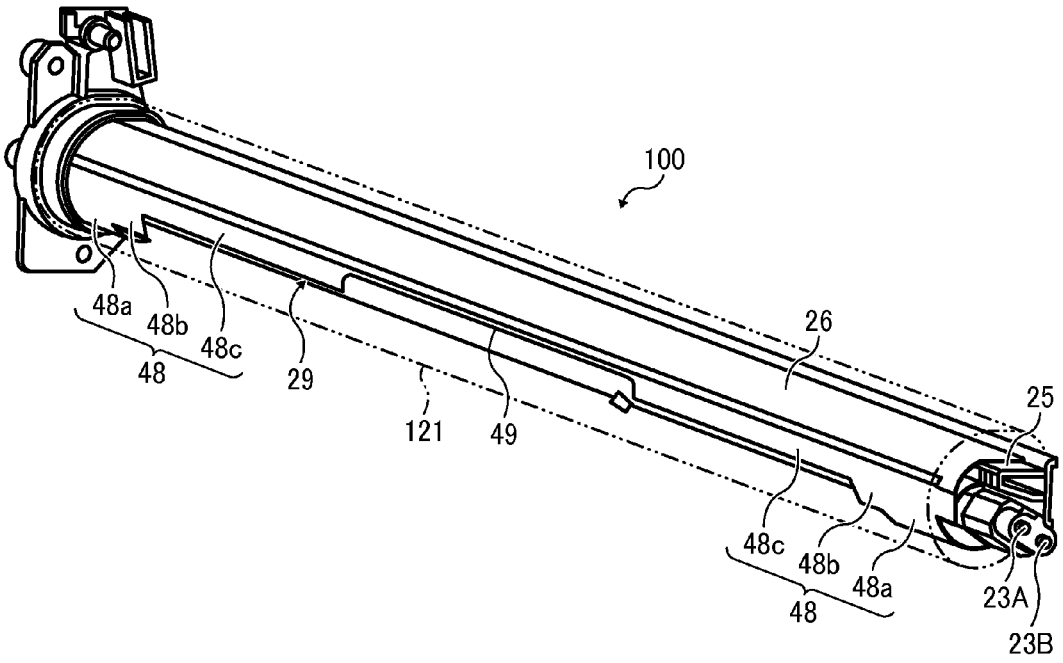
FIG. 6 is a perspective view of the fixing device illustrating a state in which the shielding member is moved to a shielding position for a small-size sheet of paper.
Figure 7:
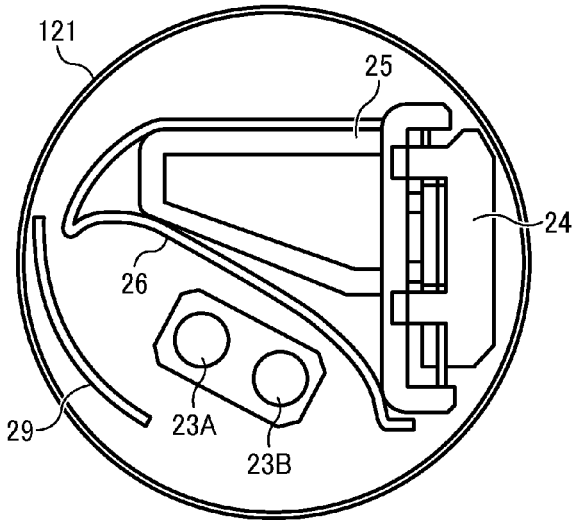
FIG. 7 is a cross-sectional view of the fixing device illustrating a state in which the shielding member is moved to a shielding position for a small-size sheet of paper.

FIG. 6 is a perspective view of the fixing device 100 illustrating a state in which the shielding member 29 is moved to a shielding position for a small-size sheet of paper. FIG. 7 is a cross-sectional view of the fixing device 100 illustrating a state in which the shielding member 29 is moved to a shielding position for a small-size sheet of paper.

The small-size sheet width W1 shows an area with a length shorter than that of the heat generator of the halogen heater 23A. Thus, when a small-size sheet is conveyed for printing, the halogen heater 23A alone is activated. In this case, however, because the area of the fixing belt 121 heated by the halogen heater 23A exceeds the small-size sheet width W1, the shielding member 29 is moved to the shielding position for the small-size sheet.

Specifically, as illustrated in FIG. 6, the third shielding section 48*c* is moved to a position opposite the heat generator of the halogen heater 23A. With this operation, the third shielding section 48*c* can cover the area near the end of the small-size sheet width W1 to an outward area, thereby preventing the temperature rise of the fixing belt 121 in the non-sheet passing area.

Next, when a medium-size sheet is conveyed for printing, the both halogen heaters 23A and 23B are activated. When the halogen heater 23A and the halogen heater 23B are both activated, the heated range of the fixing belt 121 exceeds the medium-size sheet width W2.

Then, when the medium-size sheet is conveyed, the shielding member 29 is moved to the shielding position for the medium-size sheet. Specifically, the first shielding section 48*a* and the second shielding section 48*b* are moved to the position opposite the heat generator of the halogen heaters 23A and 23B. With this operation, the range from the near-to-end to the outward area of the medium-size sheet width W2 can be covered by the first shielding section 48*a* and the second shielding section 48*b*, thereby preventing the temperature rise of the fixing belt 121 in the non-sheet passing area.

Figure 8:
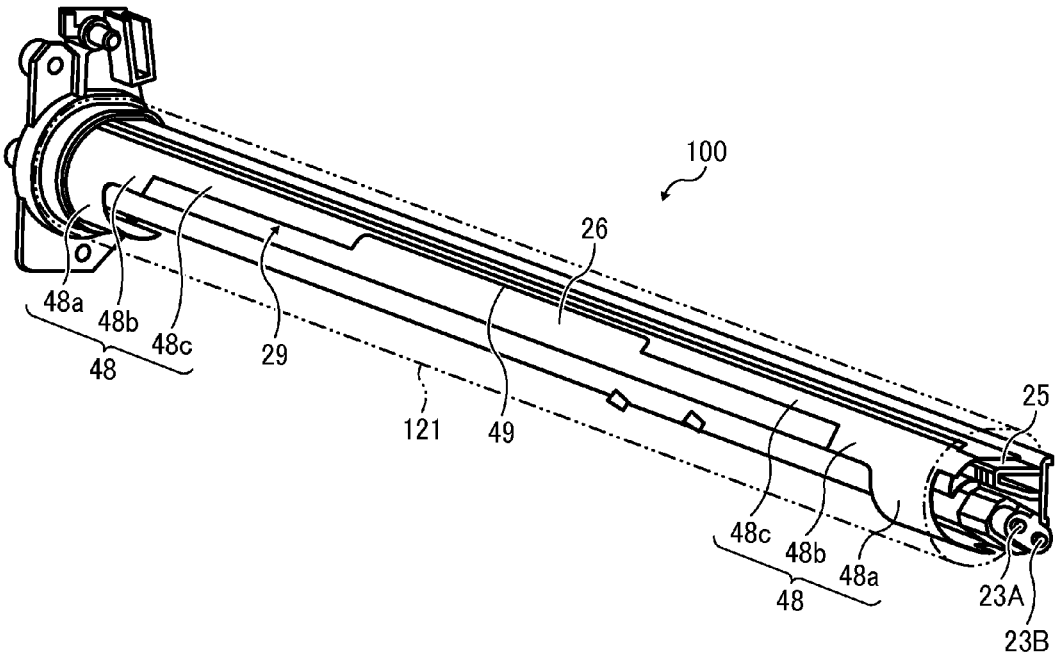
FIG. 8 is a cross-sectional view of the fixing device illustrating a state in which the shielding member is moved to a shielding position for a large-size sheet of paper.
Figure 9:
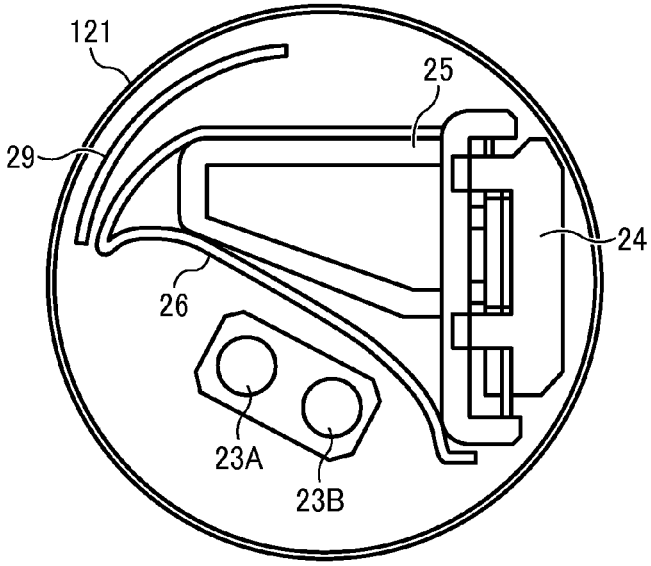
FIG. 9 is a cross-sectional view of the fixing device illustrating a state in which the shielding member is moved to a shielding position for a large-size sheet of paper.

FIG. 8 is a perspective view of the fixing device 100 illustrating a state in which the shielding member 29 is moved to a shielding position for the large-size sheet. FIG. 9 is a cross-sectional view of the fixing device 100 illustrating a state in which the shielding member 29 is moved to a shielding position for a large-size sheet of paper.

When a large-size sheet is conveyed for printing, the both halogen heaters 23A and 23B are activated. In this case, when the halogen heater 23A and the halogen heater 23B are activated, the heated range of the fixing belt 121 exceeds the large-size sheet width W3.

As a result, when a large-size sheet is passed, the shielding member 29 is moved to the shielding position for the large-size sheet. Specifically, as illustrated in FIG. 8, the second shielding section 48*b* and the third shielding section 48*c* are not exposed to the halogen heaters 23A and 23B. Instead, the shielding member 29 is moved such that the first shielding section 48*a* is positioned opposite the heat generator of the halogen heater 23B.

With this configuration, because the first shielding section 48*a* covers the range from the near-to-end to the outward area of the large-size sheet width W3, the temperature rise of the fixing belt 121 in the non-sheet passing area can be prevented.

Further, in FIGS. 6 to 9, to simplify the operation of the shielding member 29 depending on the difference of the size of the sheet, one of the two shielding members 29 is illustrated and the illustration of the pressure roller 122 and the like is omitted.

Thus, by providing the shielding member 29, even when the sheet with a narrower width than the halogen heaters 23A and 23B in the fixing belt width direction, is continuously passed through the fixing device 100, an excessive heat rise in the non-sheet passing area of the fixing belt 121 can be prevented.

On the other hand, because the shielding member 29 shields radiant heat from the halogen heaters 23A and 23B, the temperature of the shielding member 29 rises around a portion where much of the radiant heat from the halogen heaters 23A and 23B is received.

In addition, when the sheet is continuously conveyed, the temperature of the shielding member 29 also changes in accordance with the number of sheets that has been conveyed for printing. In general, as the number of sheets increases, the temperature of the shielding member 29 increases. As a result, to prevent the temperature of the shielding member 29 from exceeding the heat-resistant temperature, an upper limit is provided to the number of sheets to be conveyed continuously or the sheet conveyance speed is reduced, and the sheet conveyance is suspended for a while, which may result in a productivity decline.

The fixing device 100 according to the present embodiment is configured to include two shielding members 29*a* and 29*b* between the fixing belt 121 and the halogen heaters 23A and 23B. In addition, each of the shielding members 29*a* and 29*b* is separate from the other and moves independently between the shielding position and the retracted position. As a result, operations of each of the shielding members 29*a* and 29*b* can be finely controlled. In addition, because the non-contacting state of the shielding members 29*a* and 29*b* each other is maintained, transmission of heat between the shielding members 29*a* and 29*b* can be minimized.

Figure 10:
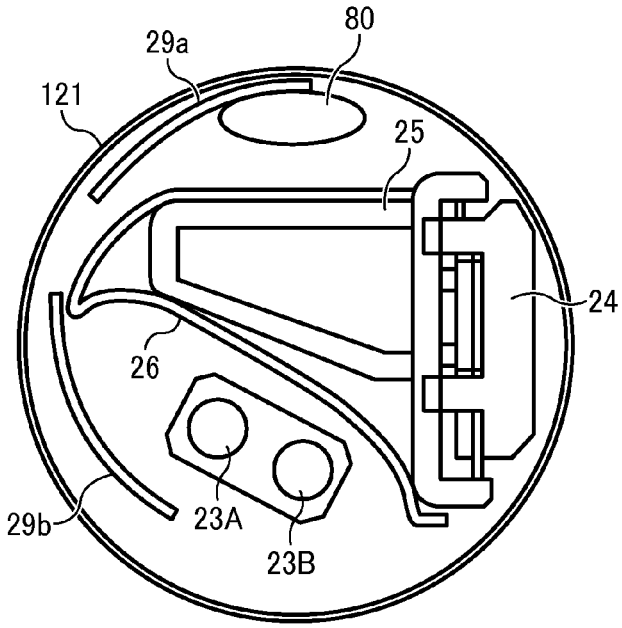
FIG. 10 illustrates the fixing device including two shielding members, of which positions are switched compared to FIG. 1.

Specifically, among two shielding members 29*a* and 29*b*, one is positioned at the shielding position and the other is positioned at the retracted position where radiant heat from the halogen heaters 23A and 23B is not projected. For example, as illustrated in FIG. 1, the shielding member 29*a* is positioned at the shielding position and the shielding member 29*b* is positioned at the retracted position. Then, at a predetermined timing based on the previously set number of sheets to be conveyed and the period of the sheet conveyance, the controller controls each shielding member 29*a*, 29*b* via the driving device and switches each position of the shielding member 29*a* and the shielding member 29*b* as illustrated in FIG. 10.

With such control, the shielding member 29*b* that has been positioned at the retracted position before switching is moved to the shielding position so that the radiant heat is prevented continuously. At the same time, the shielding member 29*a* heated at the shielding position before switching can be moved to the retracted position so as not to be heated.

As a result, that the shielding member 29*a* positioned at the shielding position before switching is heated excessively beyond the heatproof temperature can be prevented. As a result, without causing productivity decline by previously setting a limit to the number of prints, reducing the sheet conveyance speed, or temporarily suspending printing operation, an excessive rise of the temperature of the shielding member 29*a* and deformation caused by the excess of the heat can be prevented.

Further, even after switching each position of the two shielding members 29*a* and 29*b*, the relative position can be switched based on the previously set number of prints and time period.

Further, relation between the number of prints and time period and the temperature of the shielding member 29 can be evaluated in advance through experiments so that the number of prints and time period until the shielding member 29 attains the heatproof temperature can be recognized, and the timing to switch the position of the two shielding members 29 can be determined accordingly. Then, each shielding member 29 can be used in a preferred state in which the surface of the shielding member 29 is not degraded due to the increase of the temperature and the reflectivity is not reduced.

In addition, two shielding members 29 are independently movable and disposed not contacting each other, so that while the shielding member 29*a* is heated in the shielding position, the shielding member 29*b* positioned at the retracted position is prevented from being heated by contacting the shielding member 29*a*.

Figure 11:
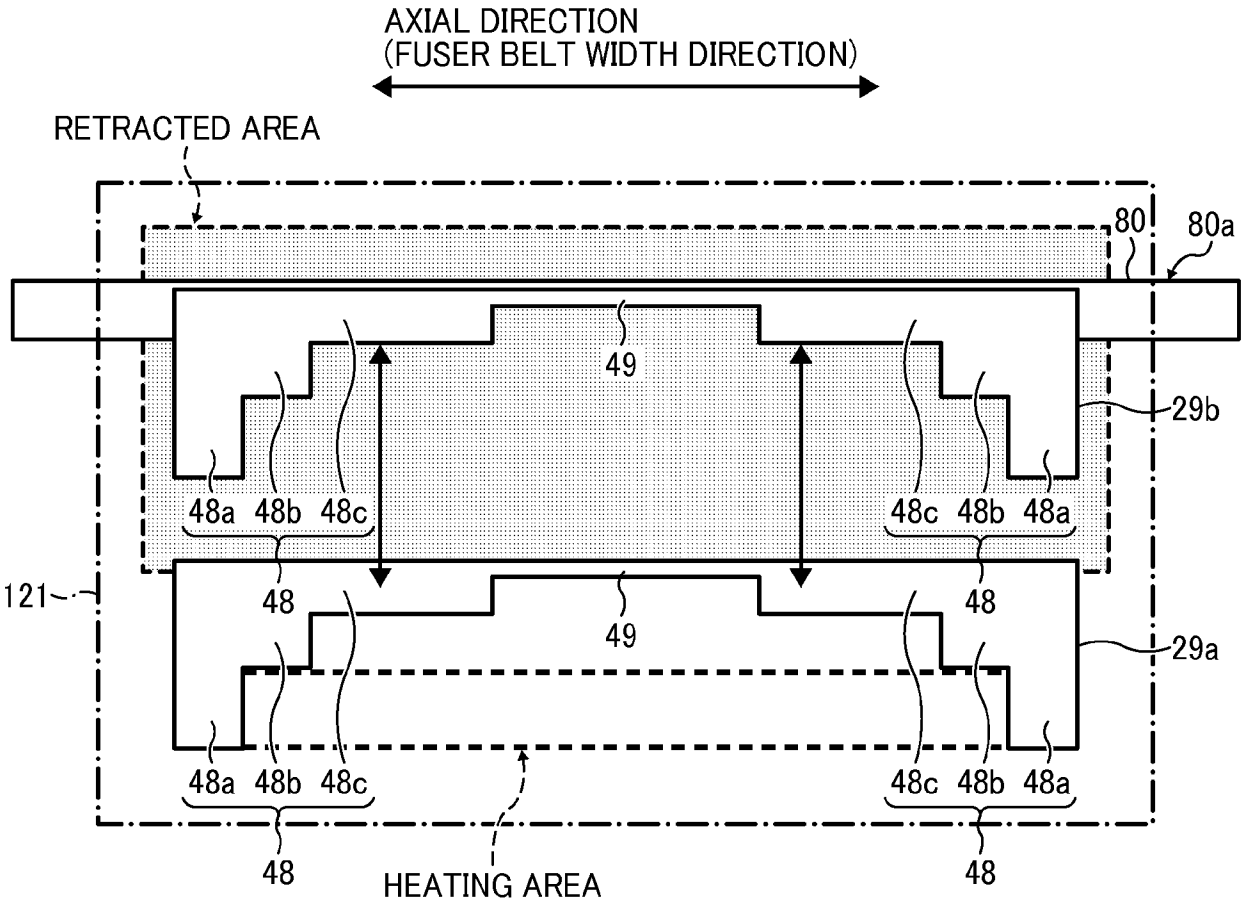
FIG. 11 is a plan view illustrating relative positions of the two shielding members and a cooling device.

As illustrated in FIGS. 1 and 11, a cooling member 80 can be disposed to bridge the interior and exterior of the fixing belt 121 to cool the shielding member 29. The cooling member 80 is disposed at a position to contact the shielding member 29 in the retracted position and not to contact the shielding member 29 in the shielding position. Further, not to degrade fusing effect, the cooling member 80 is disposed neither at a position receiving the light from the halogen heaters 23A and 23B nor in contact with the fixing belt 121 and the nip-forming member 24.

Then, the cooling member 80 contacts the shielding member 29 that is positioned at the retracted position, at a center portion of the axial direction of the cooling member 80. The heat is transmitted from the shielding member 29 to the cooling member 80, so that the shielding member 29 is cooled. In addition, the cooling member 80 includes a heat discharge portion 80*a* at an edge in the axial direction thereof. Air is blown to the heat discharge portion 80*a* to improve heat-discharging effect from the cooling member 80, so that the cooling member 80 can reduce the temperature of the shielding member 29 effectively. In addition, cooler the wind to blow to the axial edge of the cooling member 80, better the cooling effect.

In addition, if the cooling member 80 further includes a cooling fin disposed at an edge in the axial direction of the heat discharge portion 80*a*, a surface area of the heat discharge portion 80*a* is increased compared to a case without the cooling fin, so that the heat reduction effect of the shielding member 29 positioned at the retracted position is further improved.

Preferred materials for the cooling member 80 are optimal heat conductive metals such as aluminum. Accordingly, a heat pipe formed of aluminum, for example, can be used for the cooling member 80.

The two shielding members 29*a*, 29*b* are formed to deal with the same size of sheet. On the other hand, because the A4-sheet is in general most frequently used, one shielding member 29 is configured to deal with two types of sheet size; the shielding member 29*a* is configured to deal with a combination of A4-width-size and a postcard size. Then, the shielding member 29*b* deals with the combination of A4-width size and B5-width size. Thus, the shielding member 29*a* and the shielding member 29*b* can be configured to deal with different sizes.

In addition, positions of the shielding members 29*a* and 29*b* are switched at a predetermined timing as described above only in the case of A4-width-size having a higher use rate with a high possibility of continuous printing. On the other hand, in the case of low-use-rate sheet size such as a postcard or B5-width size, the shielding member 29*a* or the shielding member 29*b* is not heated excessively. In this case, the positions of the shielding members 29*a* and 29*b* need not be switched as described above.

In addition, in the present embodiment, the shielding members 29 are separate and each member is configured to be movable between the shielding position and the retracted position. However, the number of shielding members 29 is not limited to only two. Specifically, at least two shielding members 29 may be disposed, non-contacting state between the members is secured, and each may move independently between the shielding position and the retracted position.

In addition, two shielding members 29*a* and 29*b* each may be configured to move relatively. For example, in the embodiment as illustrated in FIG. 4, the retracted position where the shielding member 29*b* is positioned is shifted upstream in the fixing belt rotating direction and is set as an upstream retracted position. Then, a downstream retracted position is set at a downstream in the rotation direction of the fixing belt than the above upstream retracted position and at a non-direct heating area upstream in the rotation direction of the fixing belt than the shielding position where the shielding member 29*a* is positioned in FIG. 4.

In this downstream retracted position, the shielding member 29*a* and the shielding member 29*b* can be overlapped vertically and contactless in the radial direction of the fixing belt. Further, the shielding member 29*a* and the shielding member 29*b* are not directly heated by the radiant heat.

The shielding member 29*a* and the shielding member 29*b* are configured to be movable in opposite direction each other relatively along the circumference of the fixing belt via a linkage device, not shown, driven by a single drive source, not shown, included in the driving device. As a result, for example, from a state in which the shielding member 29*a* and the shielding member 29*b* position at a downstream retracted position, the shielding member 29*a* is moved downstream in the rotation direction of the fixing belt and to the shielding position, and the shielding member 29*b* is moved upstream in the rotation direction of the fixing belt and to the upstream retracted position.

In addition, to prevent the temperature of the shielding member 29*a* that is positioned at the shielding position from exceeding its upper limit, the shielding member 29*a* is moved upstream in the rotation direction of the fixing belt at a predetermined timing described above, and the shielding member 29*b* is moved downstream in the rotation direction of the fixing belt. Specifically, the controller controls operation of the shielding member 29*a* and the shielding member 29*b* so that the shielding member 29*a* is positioned at an upstream retracted position via the downstream retracted position from the shielding position and the shielding member 29*b* is positioned at a shielding position via the downstream retracted position form the upstream retracted position.

With such control, respective positions of the shielding member 29*a* and the shielding member 29*b* are switched at a predetermined timing so that the temperature of the shielding member 29*a* that has positioned at the shielding position before switching can be prevented from increasing to exceed the heatproof temperature.

In addition, each of the shielding members 29*a* and 29*b* can be operated by a single drive source, thereby saving cost and space compared to a case of providing drive sources for each of the shielding members 29*a* and 29*b*.

Figure 12:
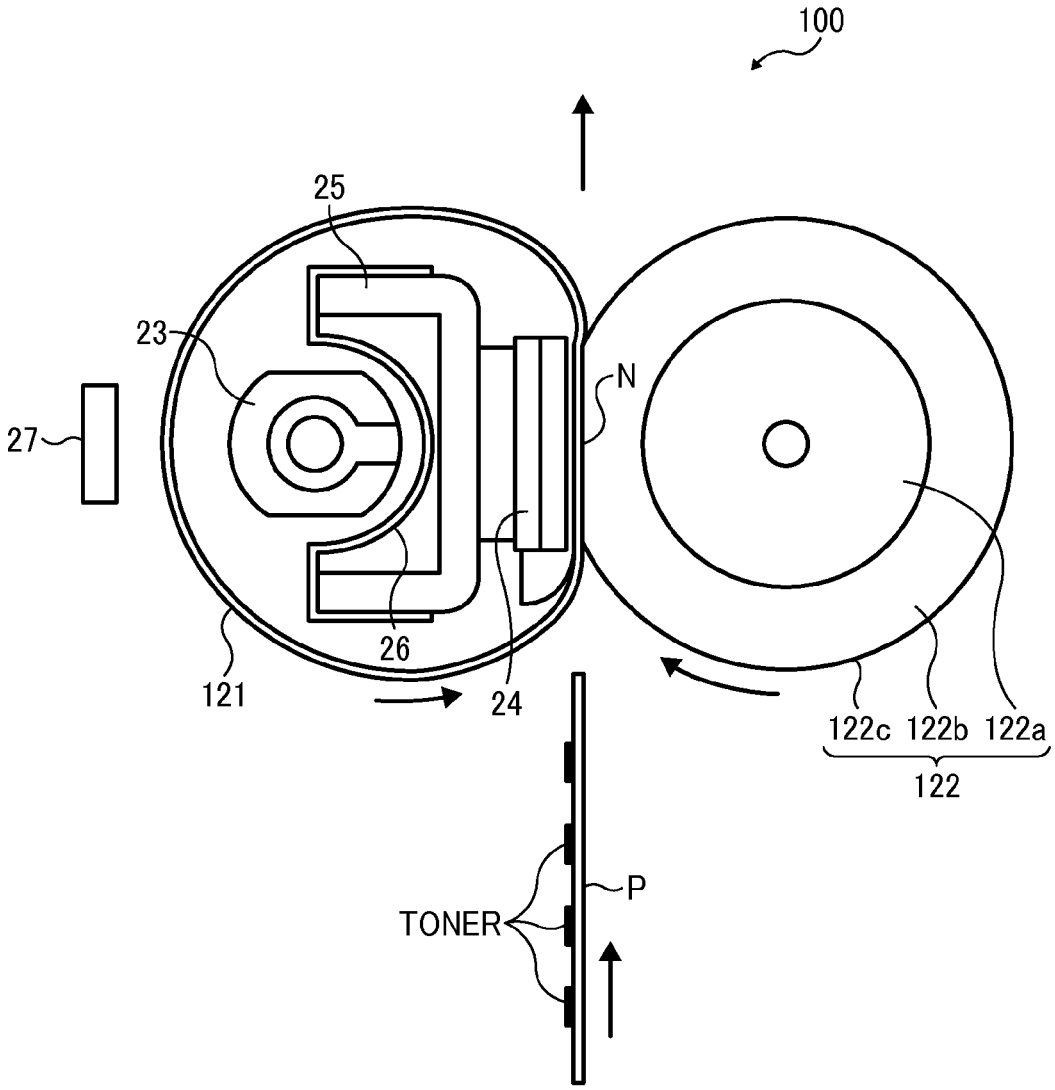
FIG. 12 is a view illustrating another structure of the fixing device.
Figure 13:
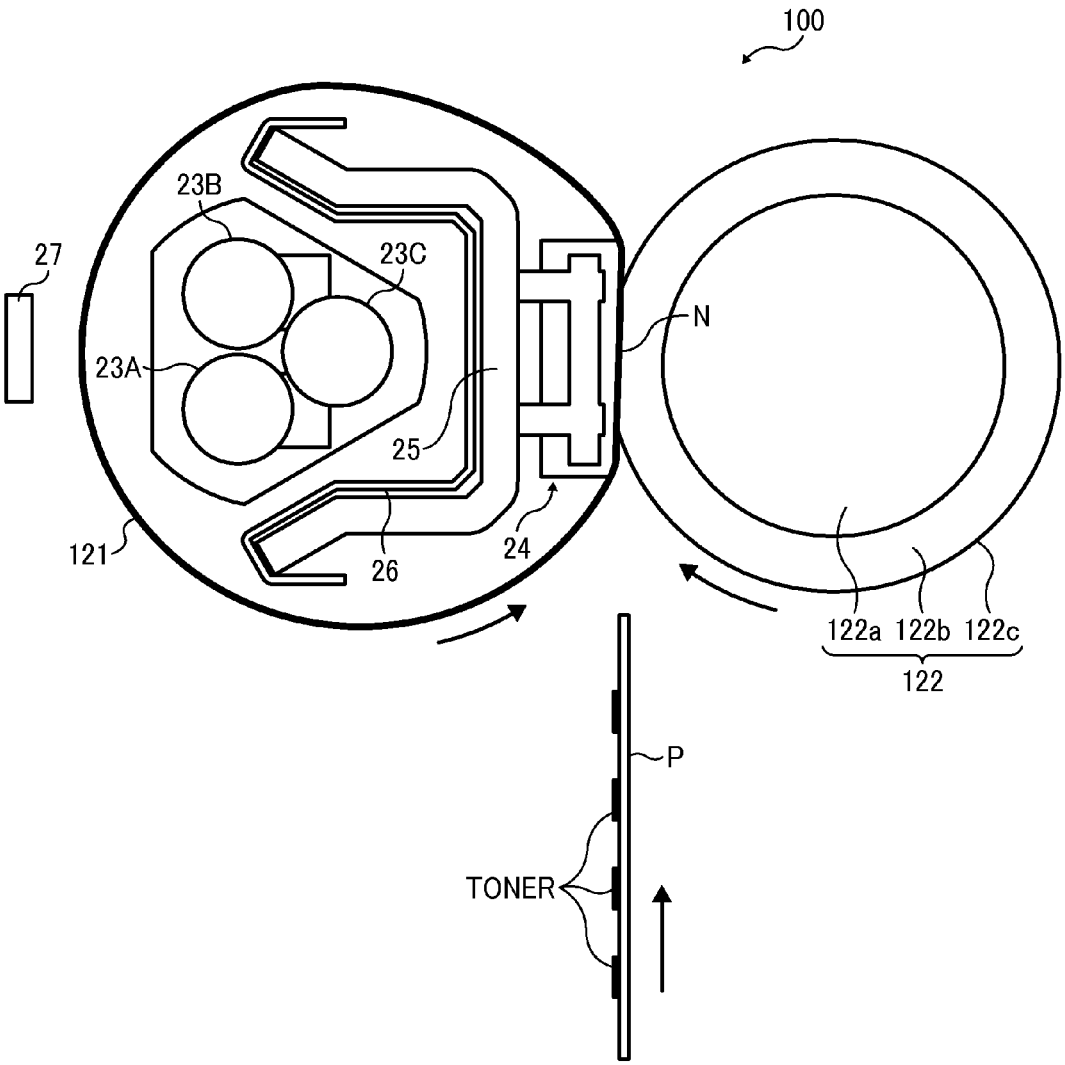
FIG. 13 is a view illustrating further another structure of the fixing device.

FIGS. 12 and 13 illustrate other structures for the fixing device 100 for use in the image forming apparatus 1000 according to the embodiment of the present invention. Although not illustrated in FIGS. 12 and 13, a plurality of shielding members 29 movable between the shielding position and the retracted position is disposed between the fixing belt 121 and the halogen heater 23 as illustrated in FIG. 4.

The fixing device 100 as illustrated in FIG. 4 includes two halogen heaters 23, but the fixing device 100 as illustrated in FIG. 12 includes one halogen heater 23 and the fixing device 100 as illustrated in FIG. 13 includes three halogen heaters 23.

Because structures of the other parts and components of the fixing device 100 as illustrated in FIGS. 12 and 13 are substantially similar to those in FIG. 4, redundant descriptions will be omitted.

In the fixing device 100 as illustrated in FIG. 12, a heat generation area of the halogen heater 23 is the whole range in the fixing belt width direction. Then, the halogen heater 23 is activated and the shielding member 29 is moved t as illustrated in FIG. 4, and the non-sheet passing area of the fixing belt 121 corresponding to the sheet size is covered by the shielding member 29. With this structure, the fixing belt 121 can be heated by areas corresponding to various sizes of the sheet.

In the fixing device 100 as illustrated in FIG. 13, each of the halogen heaters 23A, 23B and 23C includes different heating areas in the fixing belt width direction. Then, heating of the halogen heaters 23A, 23B, and 23C is controlled depending on each sheet size, and the non-sheet passing area of the fixing belt 121 is covered effectively by the shielding member 29, so that the fixing belt 121 can be heated effectively with a range corresponding to various sheet widths.

<Second Embodiment>

Next, a second embodiment to which the present invention is applied to the image forming apparatus will be described. Because the basic structure and operation of the image forming apparatus according to the second embodiment is similar to those for the image forming apparatus according to the first embodiment, redundant description concerning the same structure and operation will be omitted. The same stands for the fixing device and the redundant description concerning the same structure and operation of the fixing device will be omitted.

Figure 14:
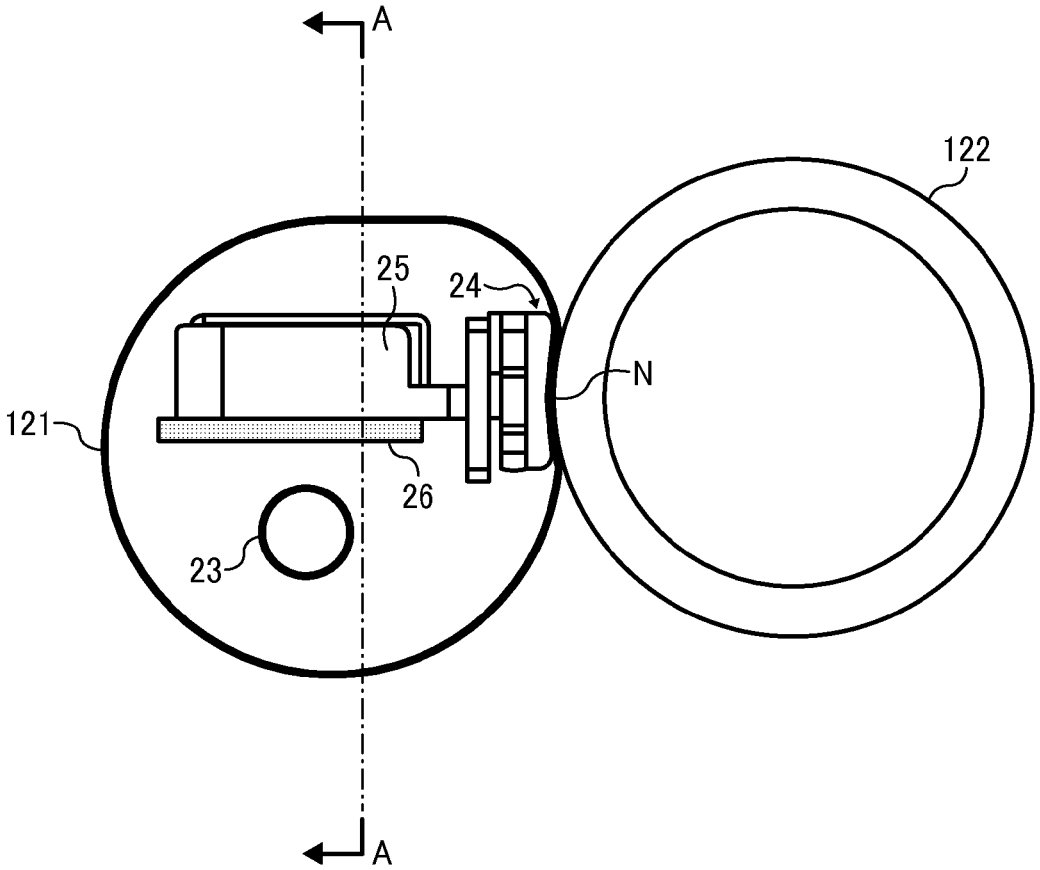
FIG. 14 BACKGROUND ART
FIG. 14 is a general configuration of a conventional fixing device configured to directly heat the fixing belt without any metallic thermal conductor.
Figure 15:
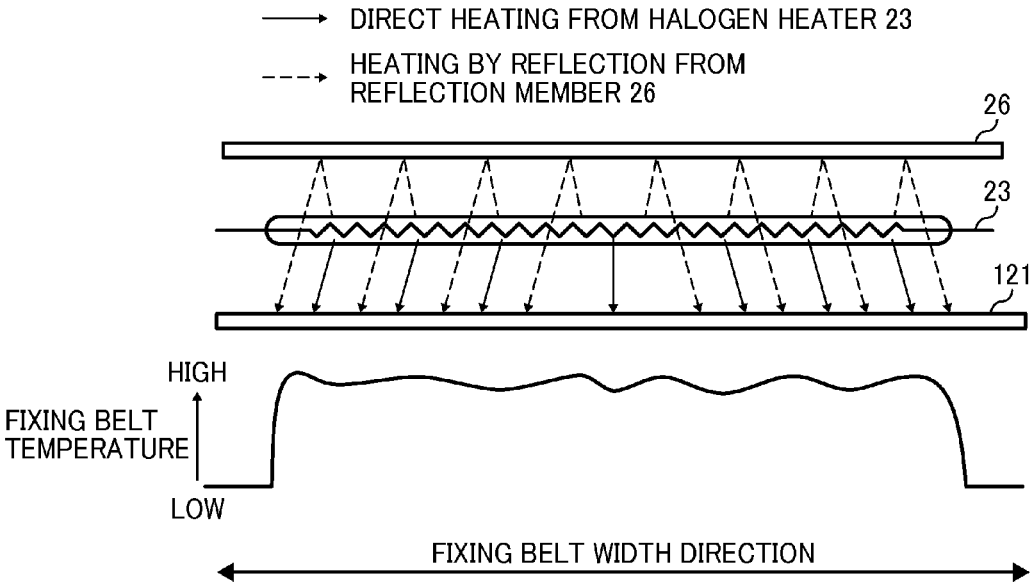
FIG. 15 is a cross-sectional view along A-A line in FIG. 14 and illustrates a temperature distribution in the width direction of the fixing belt.

FIG. 14 illustrates a schematic configuration of the conventional fixing device that heats the fixing belt 121 directly without a metallic thermal conductor. FIG. 15 illustrates a cross-sectional view of the fixing device along A-A line in FIG. 14, together with a temperature distribution of the fixing belt 121.

Heat radiated from the halogen heater as a heat source includes two types: Direct heat radiated from the halogen heater 23 to the fixing belt 121 directly (as shown by a solid line in FIG. 15), and indirect heat reflected by the reflecting member 26 and directed to the fixing belt 121 (as shown by a broken line in FIG. 15). By using both the direct heat and indirect heat as described above, the fixing belt 121 can be heated effectively.

Figure 16:
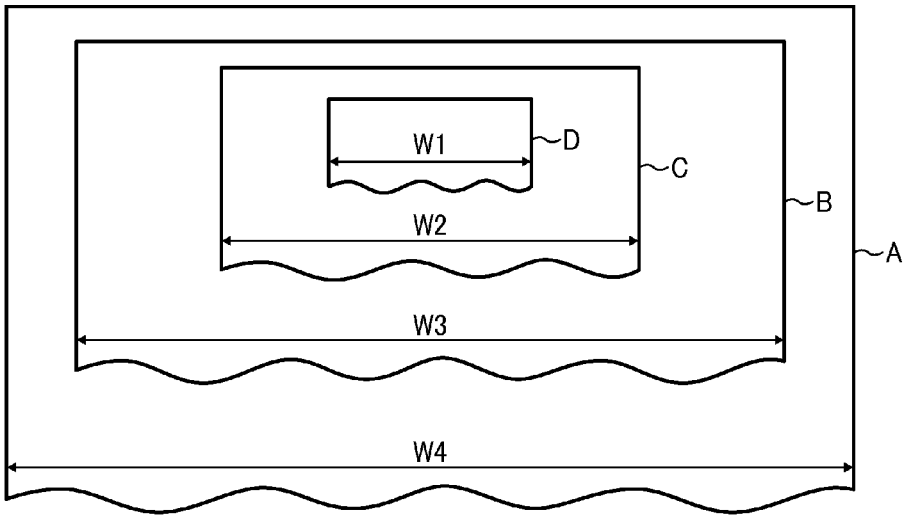
FIG. 16 illustrates various widths of the sheet usable in the image forming apparatus.

FIG. 16 illustrates four types of sheets each having a width usable in the image forming apparatus, described as examples. It is to be noted that the sheet sizes are not limited to those below:

Sheet A: Maximum-sized sheet used in the image forming apparatus such as A3 sheet having a width of W4=329 mm;

Sheet B: Frequently used sizes, such as A3-width and A4-length that equals to W3=297mm;

Sheet C: Frequently used sizes in the marketplace such as A4-width that equals to W2=210 mm; and Sheet D: Small-size sheet such as A5-width and postcard that equals to W1=100 mm.

Figure 17A:
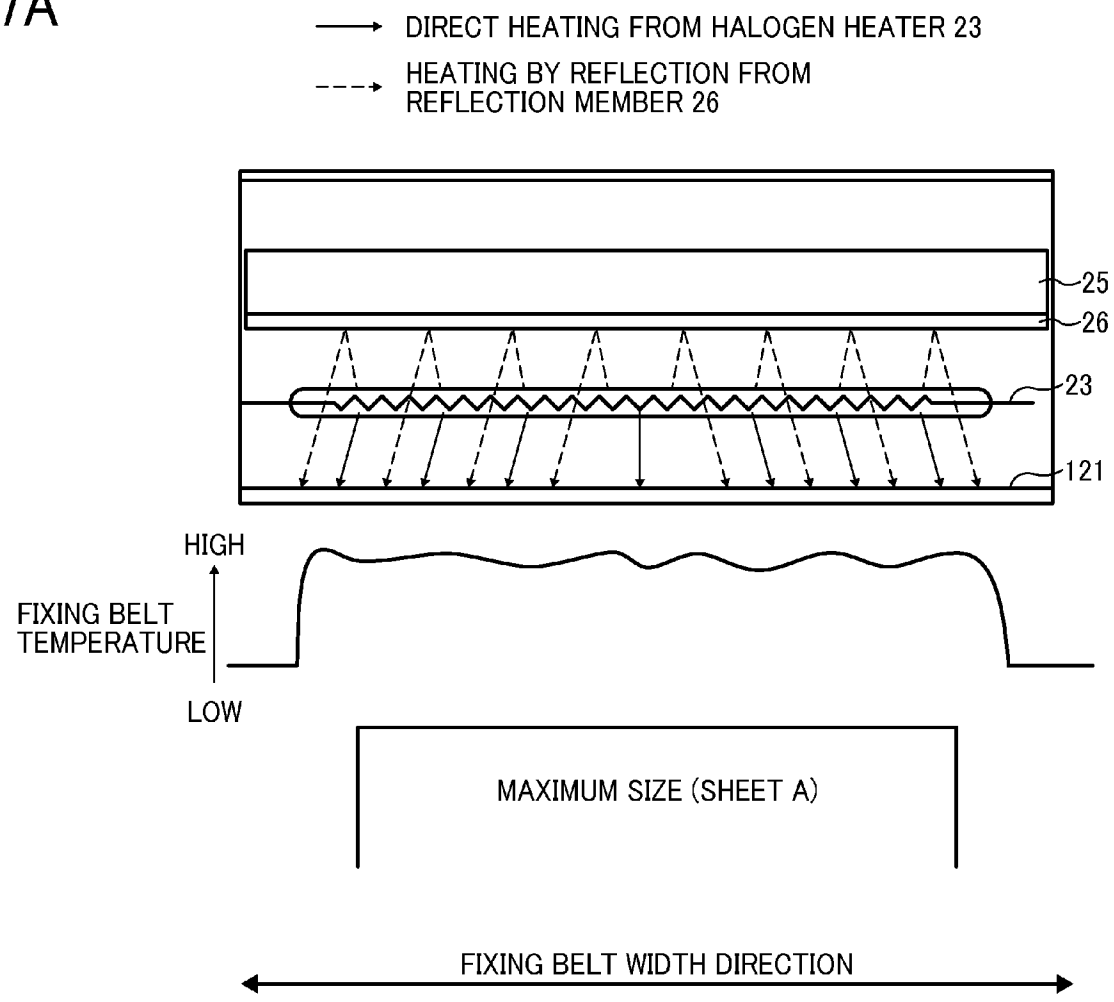
FIG. 17A is a schematic view illustrating a temperature distribution of the fixing belt when the minimum size sheet is conveyed.
Figure 17B:
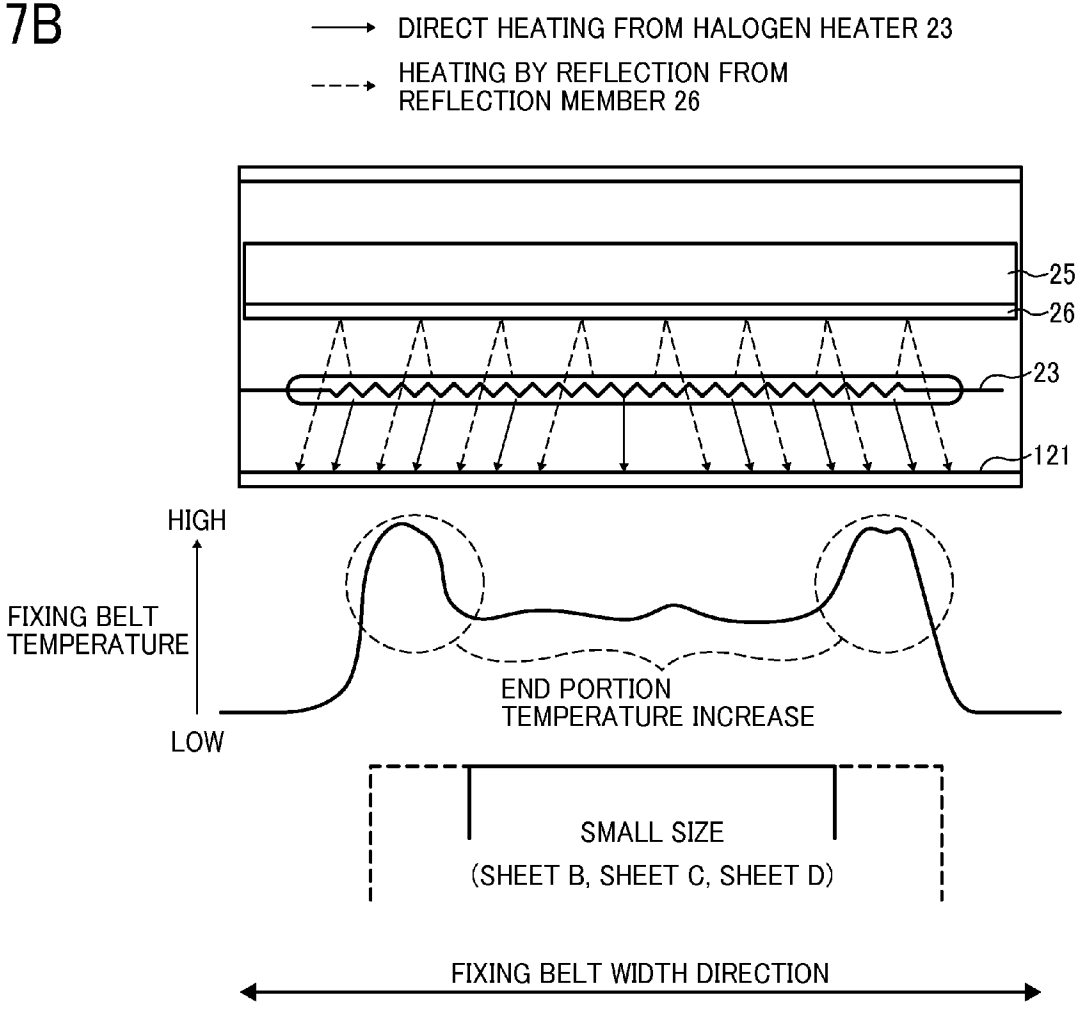
FIG. 17B is a schematic view illustrating a temperature distribution of the fixing belt when the small size sheet is conveyed.

Referring to FIGS. 17A and 17B, temperature distribution in the width direction of the fixing belt 121 due to the difference in the sheet width will be described when the fixing device including one halogen heater 23 is used.

As described in FIG. 17A, the length of the halogen heater 23 in the fixing belt width direction corresponds to a length covering the sheet width of the maximum-sized sheet A. As a result, as described in FIG. 17B, when a sheet smaller than the sheet A, such as the sheet B, sheet C, and sheet D, is used, heat is not absorbed by the sheet in areas of the fixing belt 121 where the sheet is not conveyed, and the fixing belt 121 is excessively heated in those areas. Specifically, the temperature at both lateral ends in the width direction of the fixing belt 121 increases.

Thus, the temperature rise at both ends of the fixing belt 121 continues for a long time, which may damage the fixing belt 121.

Figure 18:
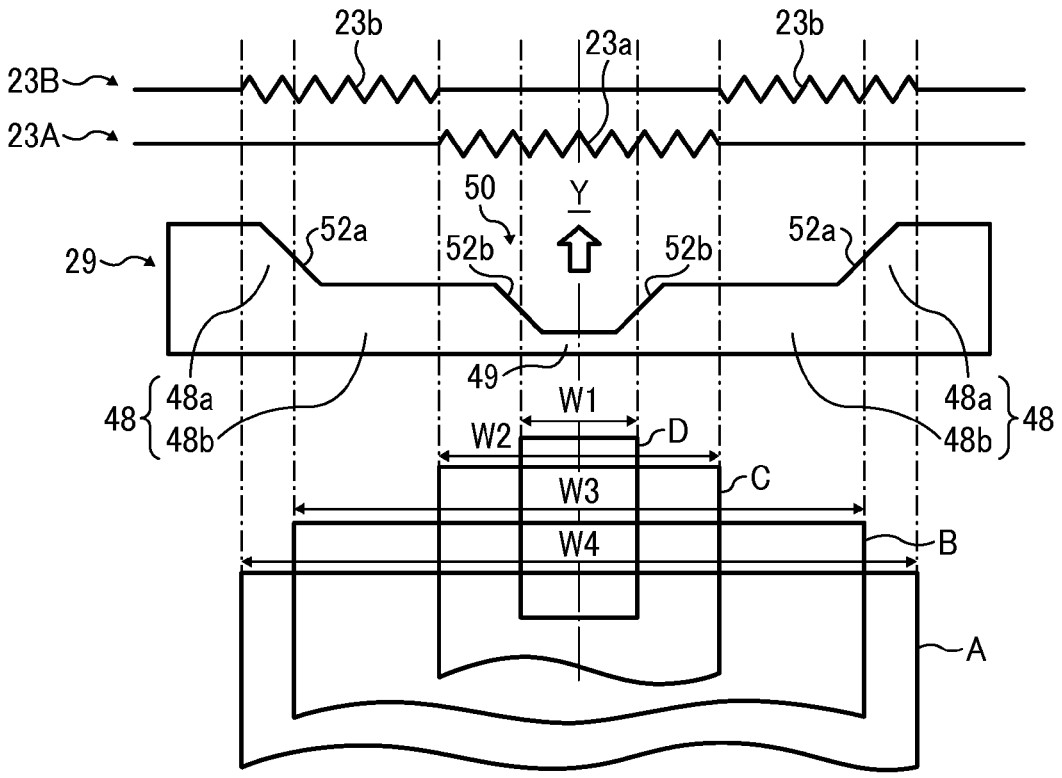
FIG. 18 is a view illustrating relations among the sheet size, shielding members, and a halogen heater.

FIG. 18 is a view illustrating relations among the sheet size, shielding members 29, and the halogen heaters 23A and 23B. In FIG. 18, two halogen heaters 23A and 23B are mounted in the fixing device 100.

Further, in the present example, to change the heating area in accordance with the sheet size, the heat generators of the halogen heaters 23A and 23B have different lengths and positions. More specifically, the heat generator of the halogen heater 23A is disposed in the center in the longitudinal direction thereof and the heat generator of the halogen heater 23B is disposed at both ends in the longitudinal direction thereof.

Table 1 represents control of the halogen heaters 23A and 23B by lighting on (YES) or off (NO) (that is, heat generation by the heat generator 23*a*, 23*b*), and control of the shielding member 29 that shields (YES) or does not shield (NO) heat from the halogen heaters 23A and 23B corresponding to the sheet size.

TABLE 1

| | HALOGEN HEATER 23A | | HALOGEN HEATER 23B | |
|---|---|---|---|---|
| | LIGHT ON | SHIELD | LIGHT ON | SHIELD |
| SHEET A | YES | NO | YES | NO |
| SHEET B | YES | NO | YES | YES |
| SHEET C | YES | NO | NO | YES OR NO |
| SHEET D | YES | YES | NO | YES OR NO |

When a sheet with a large width such as the sheet A or B is conveyed, both the halogen heaters 23A and 23B generate heat; however, when a narrower sheet such as the sheet C or D is conveyed, the halogen heater 23A alone is activated to save power.

As illustrated in FIG. 18, the shielding member 29 includes shielding parts 48 disposed at both ends thereof, and each shielding part 48 is configured to have two steps. Specifically, each shielding part 48 includes a first shielding section 48*a* with a small width in the longitudinal direction, and a second shielding section 48*b* with a large width in the longitudinal direction. The second shielding sections 48*b* are connected to each other via a connecting portion 49. The first shielding section 48*a* is continuous with the second shielding section 48*b* at a shielding side Y. In addition, the first shielding section 48*a*, the second shielding section 48*b*, and the connecting portion 49 are connected by a slanted portion 52*a* or 52*b* as illustrated in FIG. 18.

Because the first shielding section 48*a* and the second shielding section 48*b* each include the slanted portion 52*a* and the slanted portion 52*b*, an area of each heat generator 23*a* or 23*b* covered by the slanted portion 52*a* or 52*b* can be adjusted by changing the rotation position of the shielding member 29.

The shielding member 29 as illustrated in FIG. 18 deals with four sizes of sheets, i.e., the sheet A, sheet B, sheet C, and sheet D, but is not limited to these sizes.

The sheet D width W1 shows an area with a length shorter than the length of the heat generator 23*a* of the halogen heater 23A. In addition, each slanted portion 52*b* of the second shielding section 48*b* is disposed at a position overlapping the edge of the sheet D having a sheet width W1 and each slanted portion 52*a* of the first shielding section 48*a* is disposed at a position overlapping the edge of the sheet B having a sheet width W3.

Figure 19:
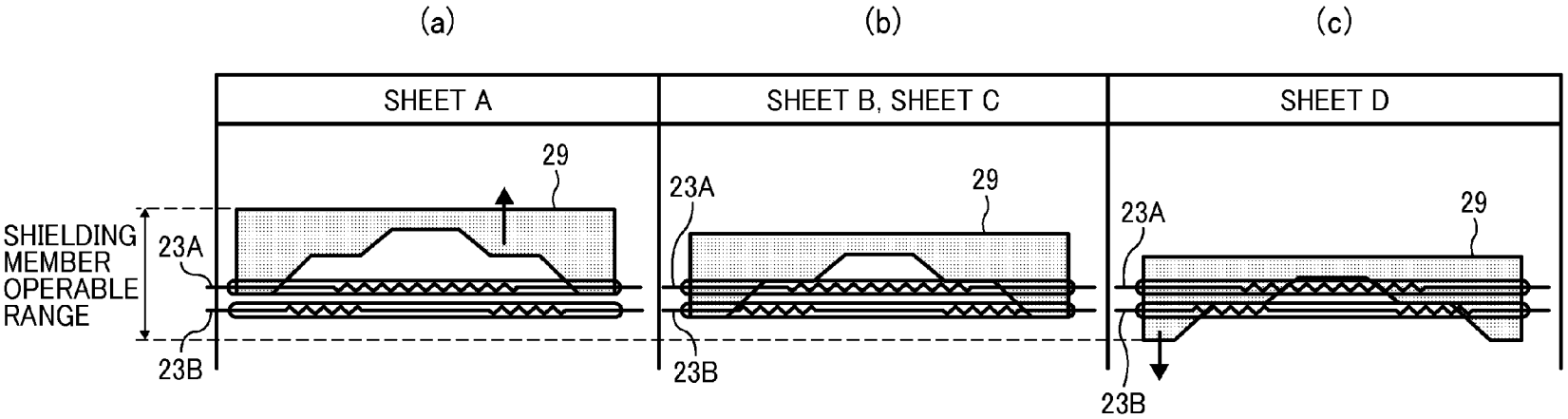
FIG. 19 schematically illustrates relative positions of the shielding member and the halogen heater, in which (a) illustrates when the sheet A is conveyed, (b) illustrates when the sheet B or C is conveyed, and (c) illustrates when the sheet D is conveyed.

FIG. 19 is a view illustrating a position of the shielding member 29 relative to the halogen heaters 23A and 23B for each sheet size. FIGS. 20, 21, and 22 are views each illustrating a state in which the shielding member 29 is positioned at a predetermined shielding position or retracted position depending on each sheet size.

FIG. 19(*c*) is a schematic view illustrating a position of the shielding member 29 relative to the halogen heaters 23A and 23B when the sheet D is conveyed for printing.

Figure 20A:
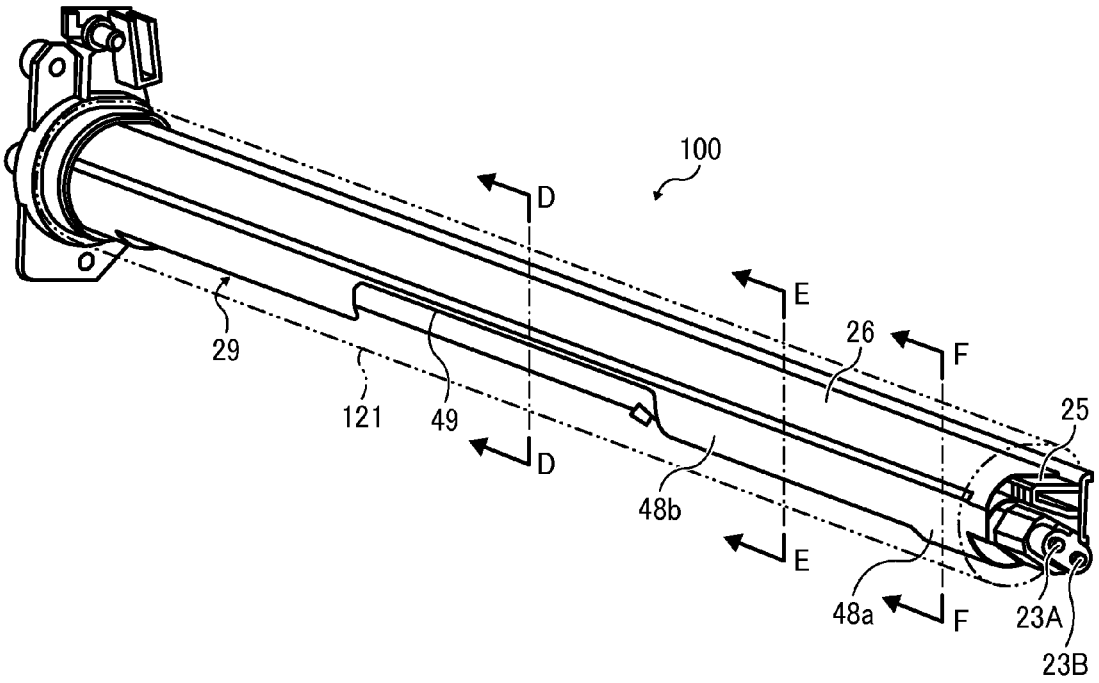
FIG. 20A is an perspective view of the fixing device in a state in which the shielding member is moved to a first retracted position when the sheet D is conveyed.
Figure 20B:
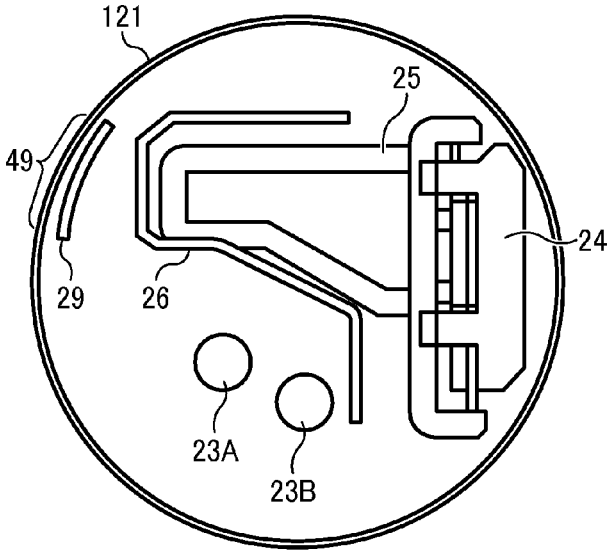
FIG. 20B is a cross-sectional view along D-D line in FIG. 20A.
Figure 20C:
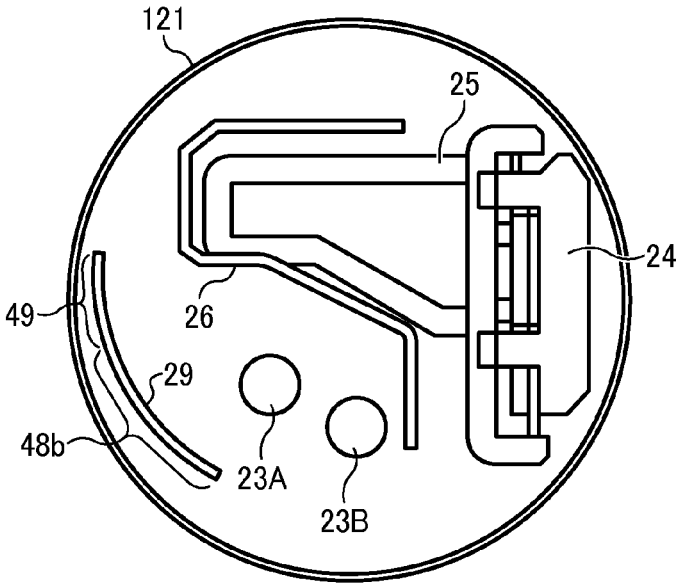
FIG. 20C is a cross-sectional view along E-E line in FIG. 20A.
Figure 20D:
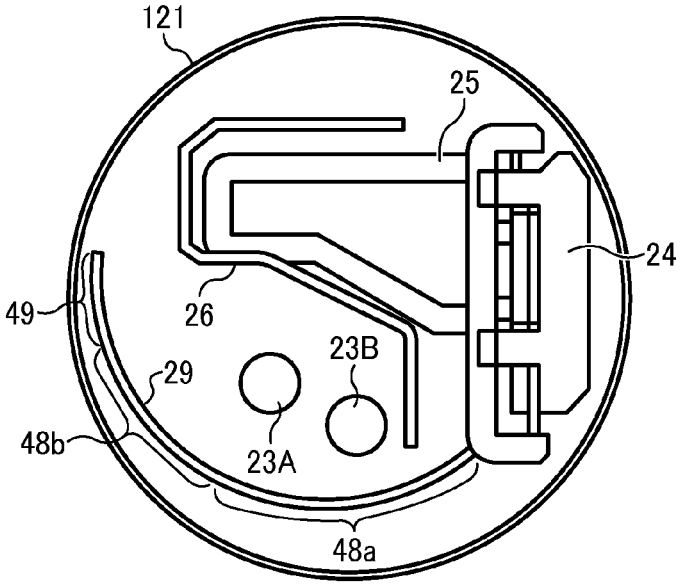
FIG. 20D is a cross-sectional view along F-F line in FIG. 20A.

FIG. 20A is a perspective view of the fixing device 100, of which shielding member 29 is moved to the first shielding position when the sheet D is conveyed. FIG. 20B is a cross-sectional view along D-D line in FIG. 20A. FIG. 20C is a cross-sectional view along E-E line in FIG. 20A. FIG. 20D is a cross-sectional view along F-F line in FIG. 20A.

When the sheet D is sent to the fixing device 100 for printing, the heat generator 23*a* of the halogen heater 23A alone is activated. In this case, however, because the area of the fixing belt 121 heated by the heat generator 23*a* of the halogen heater 23A exceeds the sheet width W1 for the sheet D. As a result, the shielding member 29 is moved to the first shielding position.

Specifically, when the sheet D is to be conveyed, heat from the heat generator 23*a* of the halogen heater 23A is shielded mainly by the second shielding section 48*b* of the shielding member 29, so that the sheet D is conveyed to a position opposite the heat generator 23*a* of the second shielding section 48*b*. As a result, especially in this case, the shielding member 29 most protrudes toward the halogen heater 23.

As a result, the second shielding section 48*b* each disposed at both sides covers an outer area from an area near the end of the sheet width W1 of the sheet D, so that the temperature rise of the fixing belt 121 in the non-sheet passing area can be suppressed.

FIG. 19(*b*) is a schematic view illustrating a position of the shielding member 29 relative to the halogen heaters 23A and 23B when the sheet B and C are conveyed for printing.

Figure 21A:
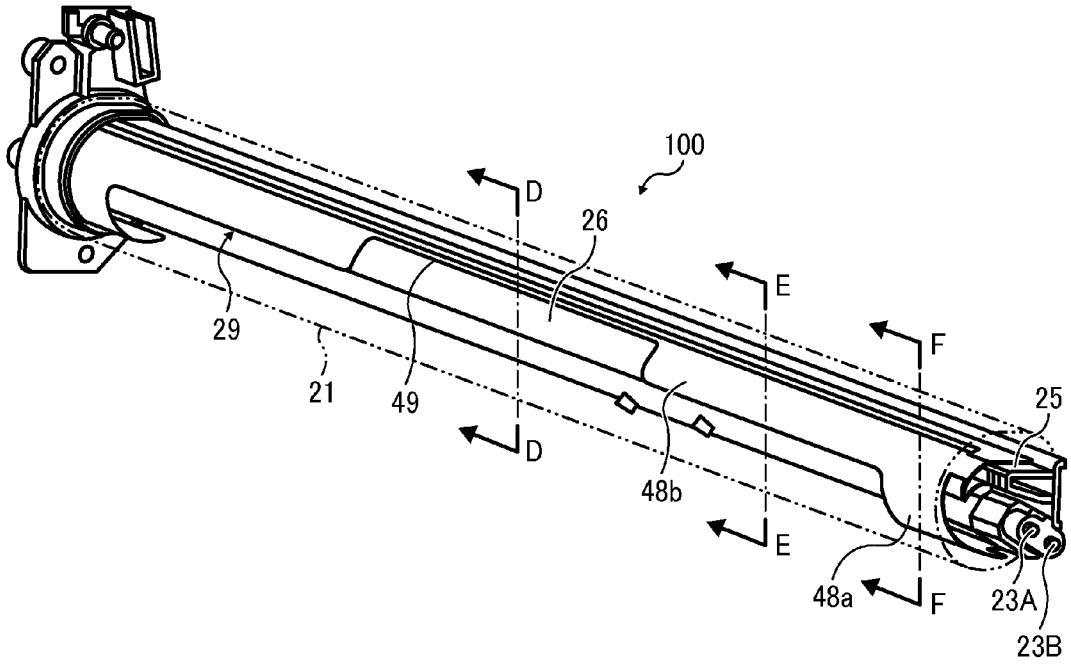
FIG. 21A is an perspective view of the fixing device in a state in which the shielding member is moved to a second retracted position when the sheet B or C is conveyed.
Figure 21B:
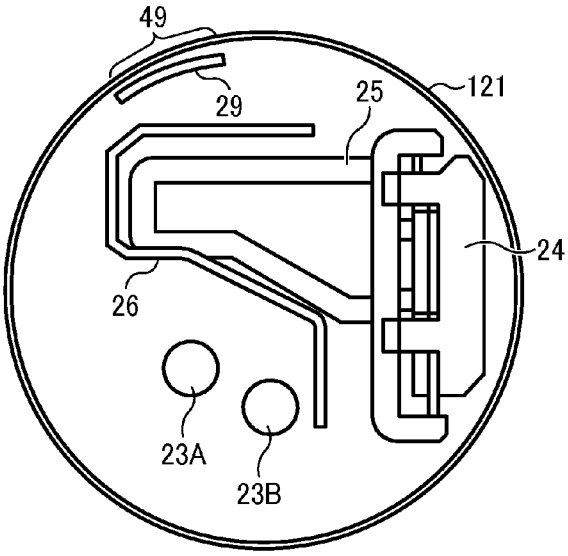
FIG. 21B is a cross-sectional view along D-D line in FIG. 21A.
Figure 21C:
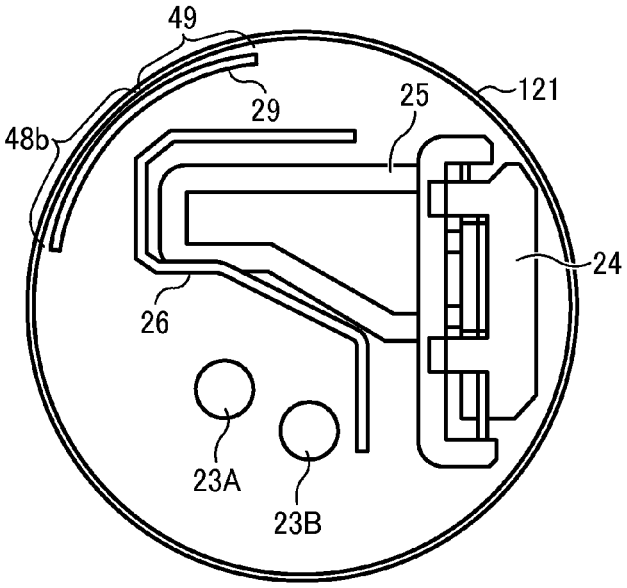
FIG. 21C is a cross-sectional view along E-E line in FIG. 21A.
Figure 21D:
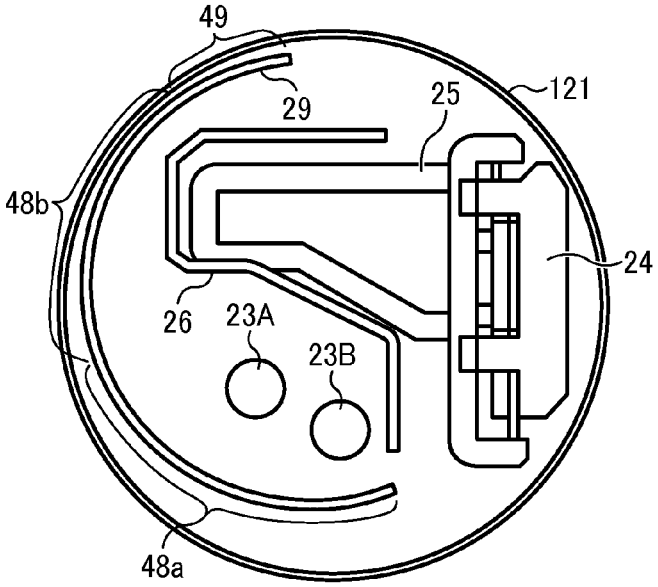
FIG. 21D is a cross-sectional view along F-F line in FIG. 21A.

FIG. 21A is a perspective view of the fixing device 100 in a state in which the shielding member 29 is moved to the second shielding position when the sheet B and C are conveyed. FIG. 21B is a cross-sectional view along D-D line in FIG. 21A. FIG. 21C is a cross-sectional view along E-E line in FIG. 21A. FIG. 21D is a cross-sectional view along F-F line in FIG. 21A.

When the sheet B and the sheet C are to be conveyed, the second shielding section 48*b* does not protrude much toward the halogen heater 23. Otherwise, the first shielding section 48*a* positions the shielding member 29 at the second shielding position covering a part of the heat generator 23*a* of the halogen heater 23B.

Figure 23A:
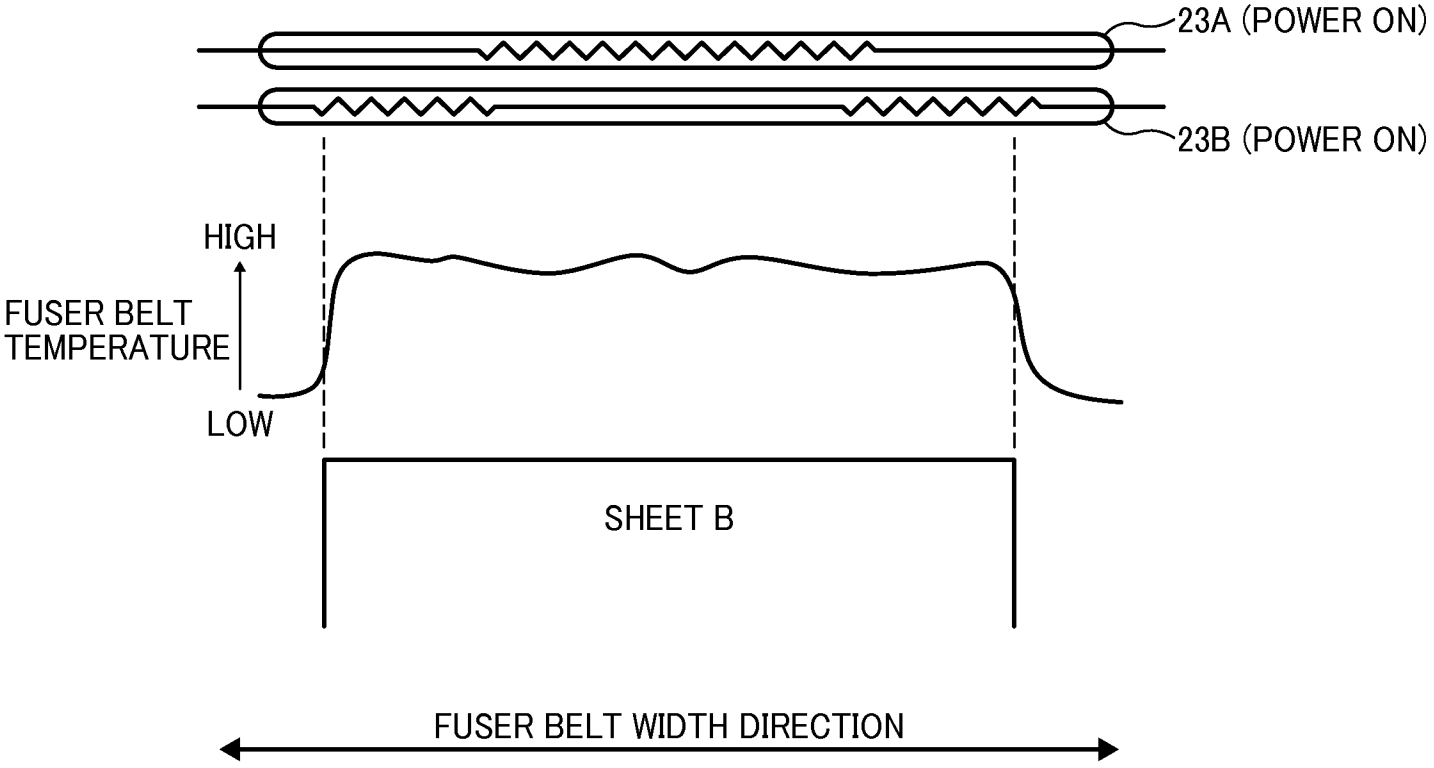
FIG. 23A schematically illustrates a temperature distribution of the fixing belt when the sheet B is conveyed.

When the sheet B is conveyed, the heat generator 23*a* of the halogen heater 23A and the heat generator 23*b* of the halogen heater 23B are activated, and an outer part in the axial direction of the heat generator 23*b* of the halogen heater 23B is covered by the first shielding section 48*a* of the shielding member 29. With this operation, outer areas from the near-to-end of the sheet width W3 of the sheet B can be covered by the both first shielding sections 48*a*, and as illustrated in FIG. 23A, the temperature rise of the fixing belt 121 in the non-sheet passing area can be suppressed.

Figure 23B:
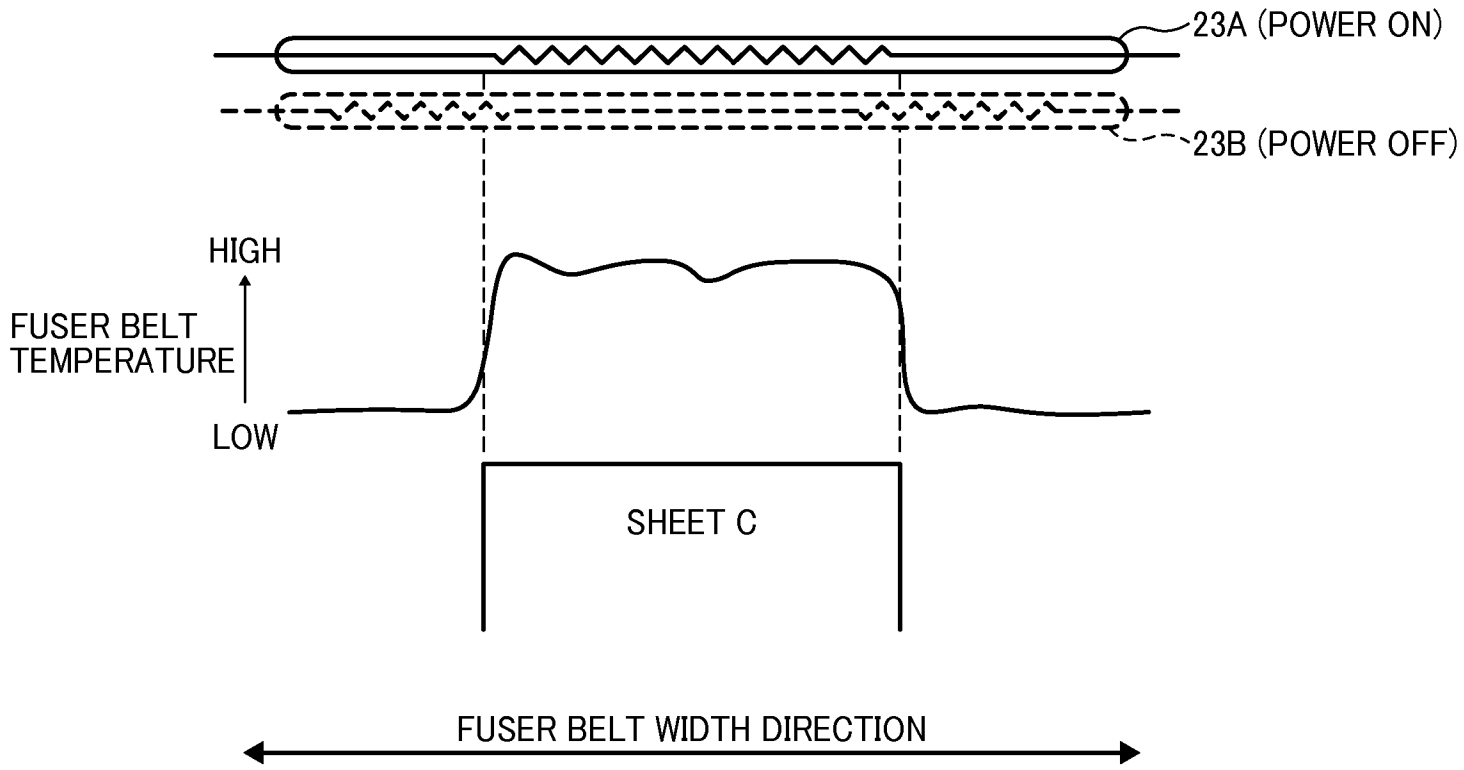
FIG. 23B schematically illustrates a temperature distribution of the fixing belt when the sheet C is conveyed.

When the sheet C is conveyed, the heat generator 23*a* alone of the halogen heater 23A corresponding to the sheet width W2 of the sheet C generates heat to heat the fixing belt. As illustrated in FIG. 23B, the temperature rise in the fixing belt 121 in the non-sheet passing area can be suppressed.

FIG. 19(*a*) is a schematic view illustrating a position of the shielding member 29 relative to the halogen heaters 23A and 23B when the sheet A is conveyed for printing.

Figure 22A:
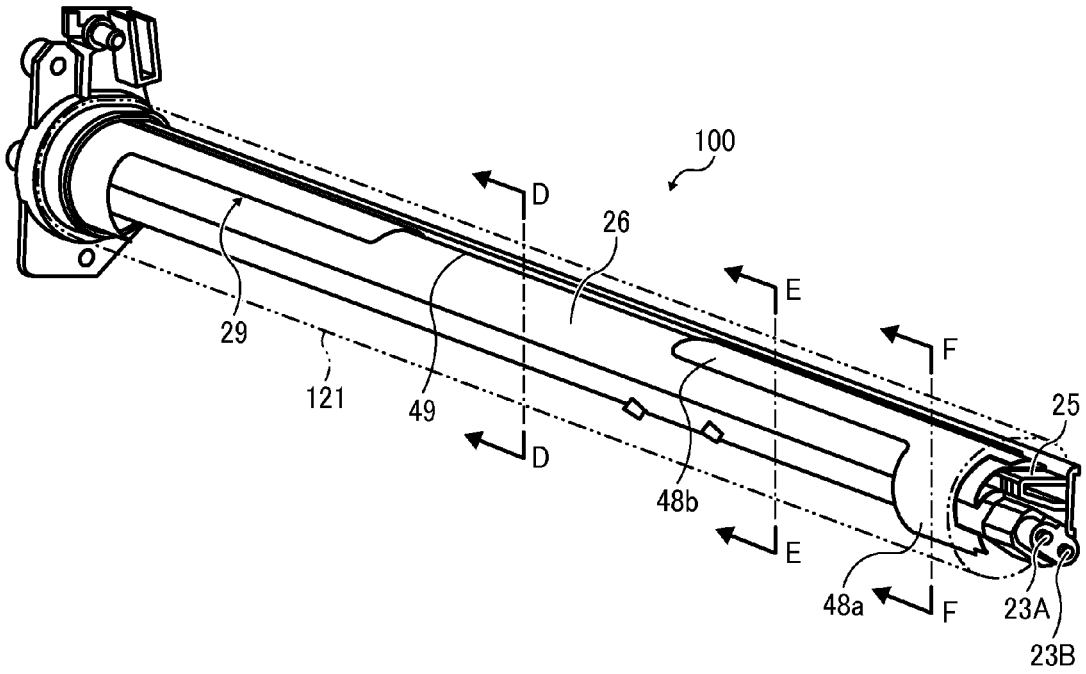
FIG. 22A is an perspective view of the fixing device in a state in which the shielding member is moved to a retracted position when the sheet A is conveyed.
Figure 22B:
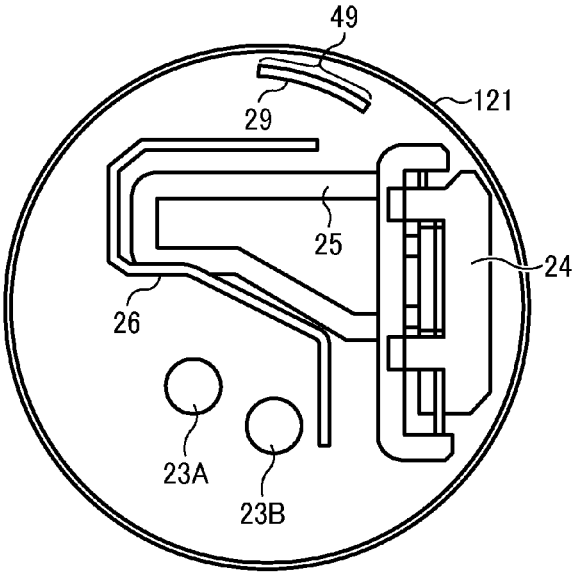
FIG. 22B is a cross-sectional view along D-D line in FIG. 22A.
Figure 22C:
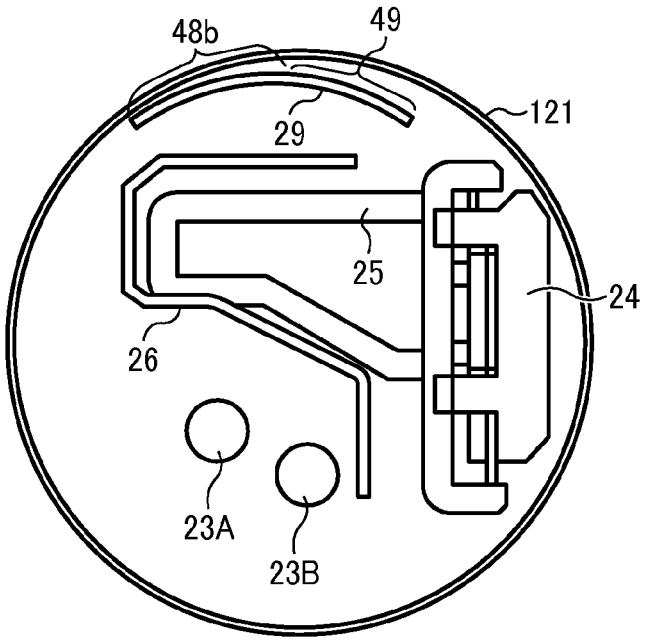
FIG. 22C is a cross-sectional view along E-E line in FIG. 22A.
Figure 22D:
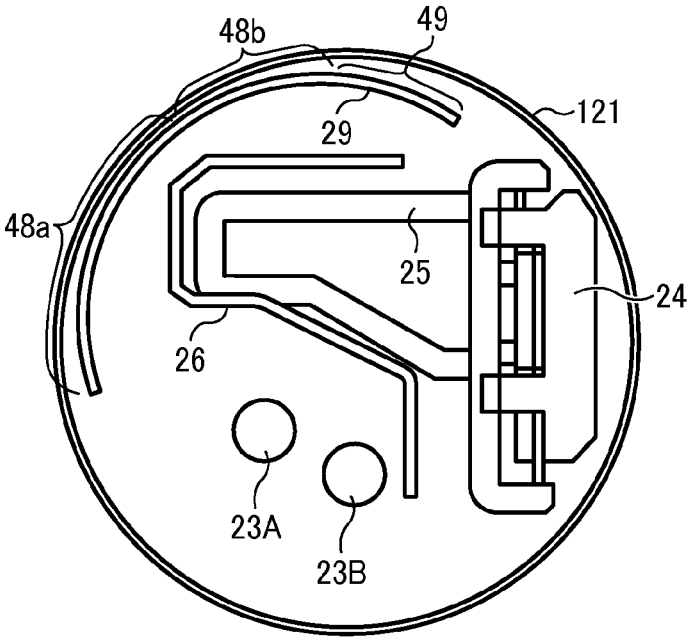
FIG. 22D is a cross-sectional view along F-F line in FIG. 22A.

FIG. 22A is a perspective view of the fixing device 100 in a state in which the shielding member 29 is moved to the retracted position when the sheet A is conveyed. FIG. 22B is a cross-sectional view along D-D line in FIG. 22A. FIG. 22C is a cross-sectional view along E-E line in FIG. 22A. FIG. 22D is a cross-sectional view along F-F line in FIG. 22A.

When the sheet A is conveyed, the shielding member 29 least protrudes toward the halogen heater 23. Specifically, by moving the shielding member 29 to the retracted position, the shielding member 29 is hidden from the halogen heater 23 by the reflecting member 26 or the stay 25.

When the sheet A is conveyed for printing, the heat generator 23*a* of the halogen heater 23A and the heat generator 23*b* of the halogen heater 23B are activated. In this case, when the halogen heater 23A and the halogen heater 23B are activated, the heated area of the fixing belt 121 becomes the same as the sheet width W4 of the sheet A. As a result, the temperature rise of the fixing belt 121 in the non-sheet passing area can be suppressed.

Herein, to deal with all the sheets A to D with only one shielding member 29, the shielding member 29 needs to move to a certain degree, which is incompatible with the requirement of compact size.

Figure 24:
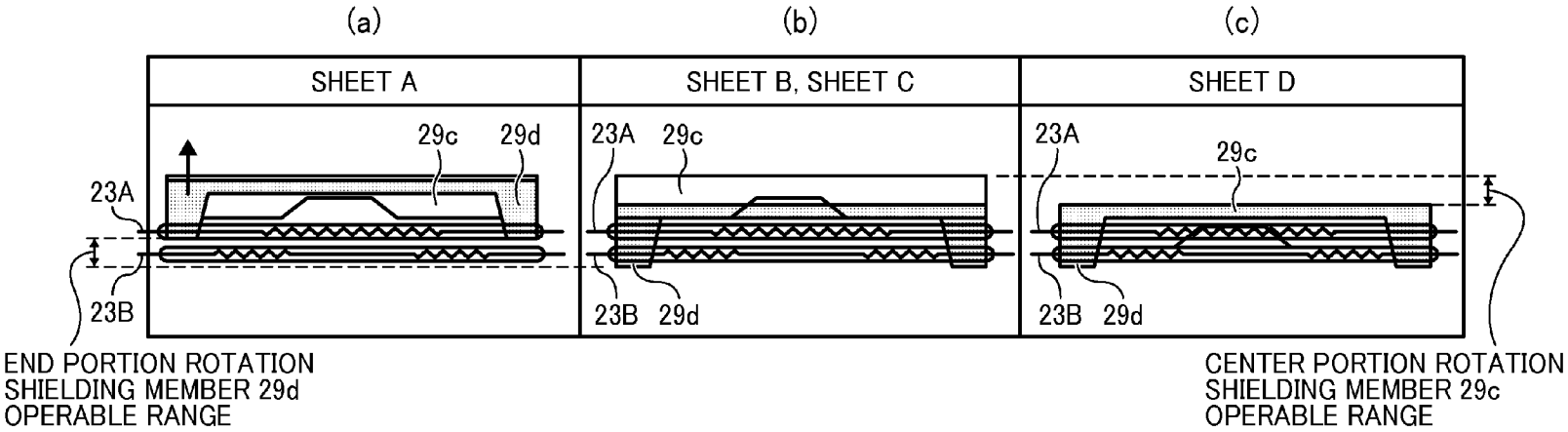
FIG. 24 schematically illustrates a fixing device including two rotary shielding members rotatable along the circumference of the fixing belt.
Figure 25:
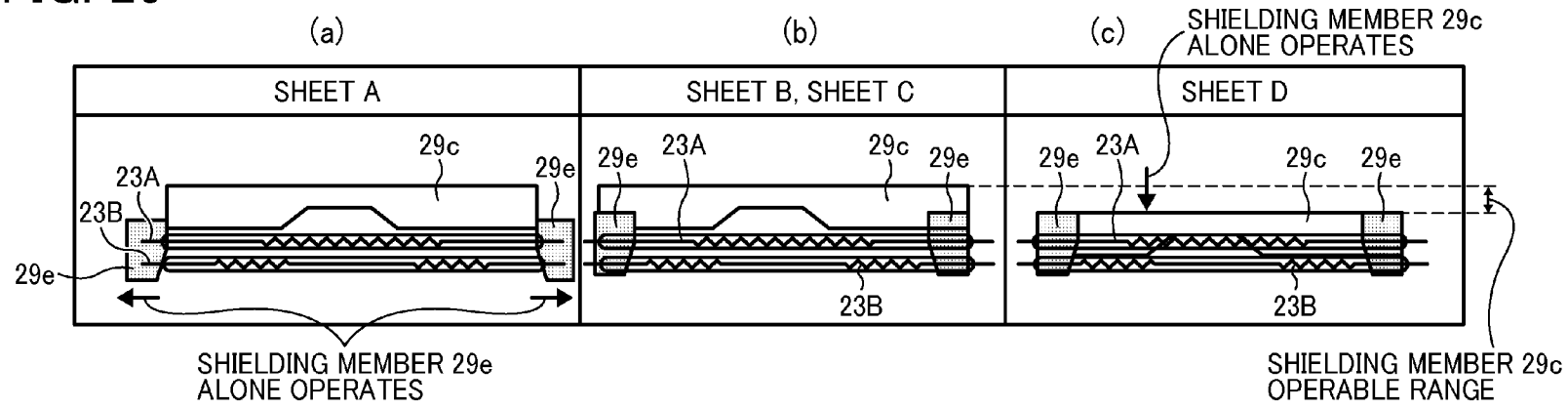
FIG. 25 schematically illustrates a fixing device including a rotary shielding member and a slidable shielding member.

Thus, in the fixing device 100 according to the present embodiment, two shielding members 29 with different shielding areas capable of shielding the radiant heat from the halogen heaters 23A and 23B are disposed between the fixing belt 121 and the halogen heaters 23A and 23B as illustrated in FIGS. 24 and 25.

Because the shielding member 29 requires heat resistance, preferred materials for the shielding member 29 are metals such as aluminum, iron, and stainless steel capable of withstanding temperatures of more than 350 degrees C. Further, at least a surface of the shielding member 29 opposite the halogen heaters 23A and 23B is formed of materials with lower heat reflectivity than that of the surface of the reflecting member 26 opposite the halogen heaters 23A and 23B. With such a structure, a localized excessive temperature rise in the reflecting member 26 due to the reflection of light from the shielding member 29 may be minimized.

In addition, the shielding member 29 is preferably formed of a material with high heat conductivity. With such a structure, a localized excessive temperature rise in the shielding member 29 may be minimized. Provision of the high heat conductive layer to the shielding member 29 may improve restrictive effect on the localized excessive temperature rise in the shielding member 29. Preferred materials for the heat conductivity layer to be provided to the shielding member 29 are metals including copper, aluminum, and nickel.

FIGS. 24(*a*) to 24(*c*) are schematic views of the fixing device 100 including two rotary shielding members rotatable along the circumference of the fixing belt.

More specifically, FIG. 24(*a*) is a schematic view illustrating positions of a center-side rotary shielding member 29*c* and an end-side rotary shielding member 29*d* relative to the halogen heaters 23A and 23B when the sheet A is conveyed for printing. FIG. 24(*b*) is a schematic view illustrating positions of the center-side rotary shielding member 29*c* and the end-side rotary shielding member 29*d* relative to the halogen heaters 23A and 23B when the sheet B and the sheet C are conveyed for printing. FIG. 24(*c*) is a schematic view illustrating positions of the center-side rotary shielding member 29*c* and the end-side rotary shielding member 29*d* relative to the halogen heaters 23A and 23B when the sheet D is conveyed for printing.

As illustrated in FIGS. 24(*a*) to 24(*c*), the end-side rotary shielding member 29*d* includes a shielding section that can block heat from the halogen heater at both end sides in the longitudinal direction of the halogen heater, and the center-side rotary shielding member 29*c* includes a shielding section that can block heat from the halogen heater in the central part in the longitudinal direction of the halogen heater.

The shielding section of the end-side rotary shielding member 29*d* includes a shielding area similar to the first shielding section 48*a* of the shielding member 29 as illustrated in FIG. 19. The shielding section of the center-side rotary shielding member 29*c* includes a shielding area similar to the second shielding section 48*b* of the shielding member 29 as illustrated in FIG. 19.

The center-side rotary shielding member 29*c* and the end-side rotary shielding member 29*d* are rotatable along the circumference of the fixing belt between the fixing belt 121 and the halogen heaters 23A and 23B. The operation of the center-side rotary shielding member 29*c* and the end-side rotary shielding member 29*d* is controlled by the controller via the driving device having a drive source.

Each position of the center-side rotary shielding member 29*c* and the end-side rotary shielding member 29*d* is set as a reference position when the sheet B and the sheet C are conveyed as illustrated in FIG. 24(*b*). When the sheet A is conveyed, the end-side rotary shielding member 29*d* alone is moved from the reference position as illustrated in FIG. 24(*a*). When the sheet D is conveyed, the center-side rotary shielding member 29*c* alone is moved from the reference position as illustrated in FIG. 24(*c*).

With this operation, compared to the case as illustrated in FIG. 19 in which only one shielding member 29 is used to handle all sheet sizes from the sheet A to sheet D, each rotation amount of the center-side rotary shielding member 29*c* and the end-side rotary shielding member 29*d* can be made smaller, that is, each moving range is made smaller. Accordingly, the internal space of the fixing belt 121 can be saved, thereby making the entire fixing device 100 smaller.

In addition, the number of shielding members 29 rotatable along the circumference of the fixing belt may be more than three.

FIGS. 25(*a*) to 25(*c*) are schematic views of the fixing device 100 including one shielding member rotatable along the circumference of the fixing belt and the other shielding member slidable in the longitudinal direction of the halogen heater, i.e., in the width direction of the fixing belt.

Specifically, a pair of end-side slidable shielding members 29*e* and the center-side rotary shielding member 29*c* that can block heat in the nearer-to-the-center-side in the longitudinal direction of the halogen heater better than the end-side slidable shielding members 29*e* can are disposed.

The center-side rotary shielding member 29*c* is rotatable along the circumference of the fixing belt between the fixing belt 121 and the halogen heaters 23A and 23B. In addition, the end-side slidable shielding member 29*e* is slidable in the longitudinal direction of the halogen heater between the fixing belt 121 and the halogen heaters 23A and 23B. The operation of the center-side rotary shielding member 29*c* and the end-side rotary shielding member 29*e* is controlled by the controller via the driving device having a drive source.

More specifically, FIG. 25(*a*) is a schematic view illustrating positions of the center-side rotary shielding member 29*c* and the end-side slidable shielding member 29*e* relative to the halogen heaters 23A and 23B when the sheet A is conveyed for printing. FIG. 25(*b*) is a schematic view illustrating positions of the center-side rotary shielding member 29*c* and the end-side slidable shielding member 29*e* relative to the halogen heaters 23A and 23B when the sheet B and the sheet C are conveyed for printing. FIG. 25(*c*) is a schematic view illustrating positions of the center-side rotary shielding member 29*c* and the end-side slidable shielding members 29*e* relative to the halogen heaters 23A and 23B when the sheet D is conveyed for printing.

Each position of the center-side rotary shielding member 29*c* and the end-side slidable shielding member 29*e* is set as a reference position when the sheet B and the sheet C are conveyed as illustrated in FIG. 25(*b*). In this case, the center-side rotary shielding member 29*c* is positioned at the retracted position and the end-side slidable shielding members 29*e* position at the shielding position.

When the sheet A is conveyed, the end-side slidable shielding members 29*e* alone are moved from the reference position as illustrated in FIG. 25(*a*). When the sheet D is conveyed, the center-side rotary shielding member 29*c* alone is moved from the reference position as illustrated in FIG. 25(*c*) and moves from the retracted position to the shielding position.

With this operation, compared to the case as illustrated in FIG. 19 in which only one shielding member 29 is used to handle all sheet sizes from the sheet A to sheet D, each rotation amount of the center-side rotary shielding member 29*c* and the end-side slidable shielding members 29*e* can be made smaller, that is, each moving range is made smaller. Accordingly, the internal space of the fixing belt 121 can be saved, thereby making the entire fixing device 100 smaller. In addition, moving directions of the center-side rotary shielding member 29*c* and the end-side slidable shielding member 29*e* are different from each other, so that an allowance to the interference with each shielding member can be improved compared to a case in which a plurality of rotary shielding members movable only along the circumference of the fixing belt is disposed.

Herein, if the center-side rotary shielding member 29*c*, the end-side rotary shielding member 29*d*, and the end-side slidable shielding member 29*e* are employed without any distinction, they are collectively denoted as the shielding member 29.

As illustrated in FIGS. 24 and 25, when a plurality of shielding members 29 is used, each shielding member 29 can be configured to move in conjunction with each other by a linkage mechanism, not shown. With this configuration, each shielding member 29 can be moved via a single drive source, so that a low cost and space-saving apparatus can be produced compared to a case in which each drive source is provided to each shielding member 29.

On the other hand, if each shielding member 29 is configured to move independently, a plurality of drive sources needs to be provided for each shielding member 29; however, each shielding member 29 can be controlled more finely.

In addition, in the present embodiment, because each shielding area of the plurality of shielding members 29 is made different, some shielding member 29 may be evacuated to the retracted position such as a rear side of the stay 25 without positioning at the shielding position in accordance with the sheet size. As a result, that the shielding member 29 receives radiant heat from the halogen heaters 23A and 23B and is heated unnecessarily may be prevented.

Accordingly, because the shielding member 29 is prevented from being heated unnecessarily, deformation of the shielding member 29 due to the heat can be minimized. Thus, degraded function due to the thermal deformation of the shielding member 29 and the interference between the deformed part and other existing members can be prevented, thereby improving the reliability of the fixing device 100.

Figure 26:
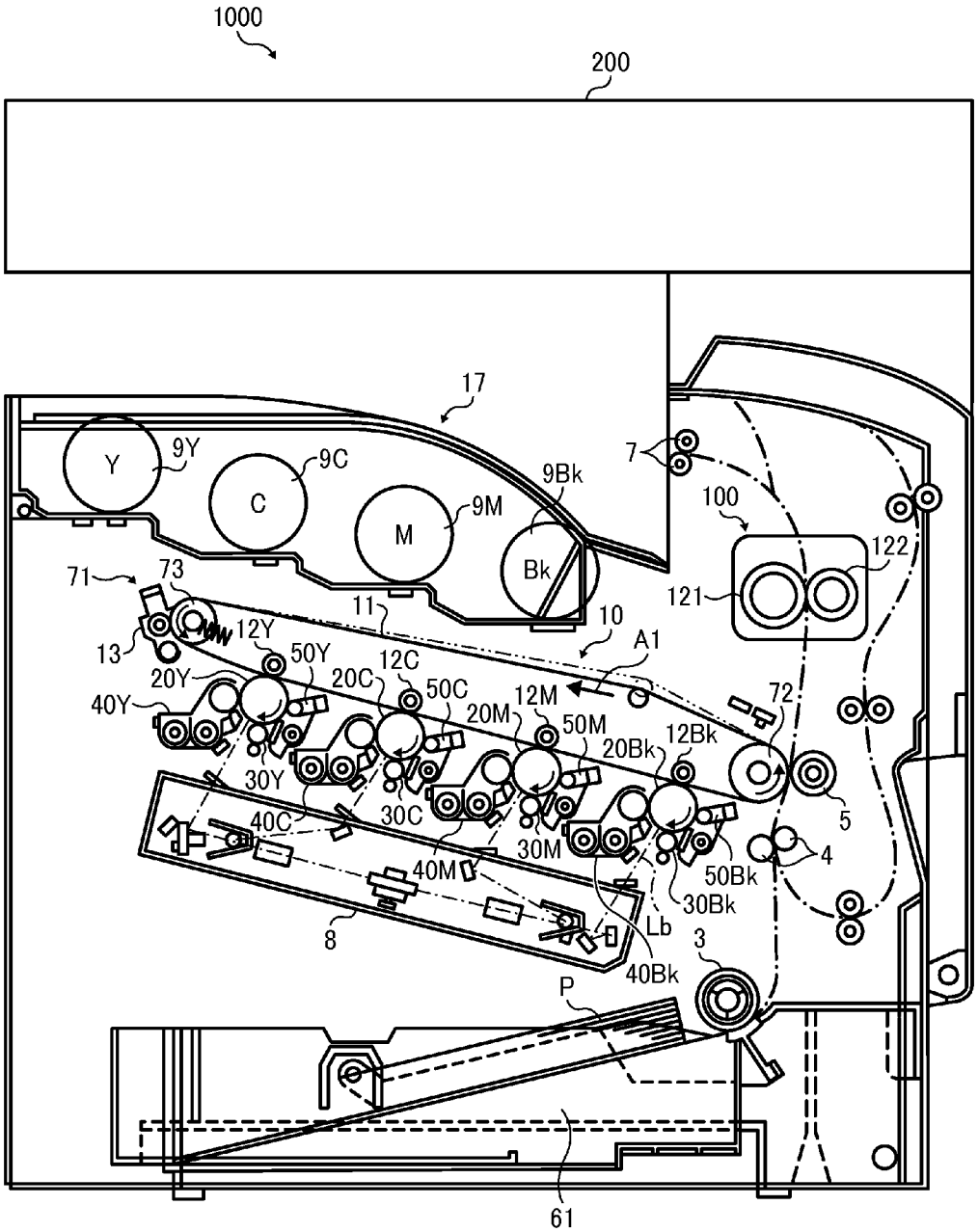
FIG. 26 illustrates another configuration of the image forming apparatus.

FIG. 26 illustrates another image forming apparatus, serving as a copier, including a scanner 200 to read image data from an original. The image forming apparatus to which the fixing device 100 according to the present invention is applied includes such an image forming apparatus as illustrated in FIG. 26, not limited to the image forming apparatus as illustrated in FIG. 2.

The aforementioned embodiments are examples and specific effects can be obtained for each of the following aspects.

<Aspect A> A fixing device includes an endlessly movable body such as a fixing belt 121 with a hollow interior; a pressure member such as a pressure roller 122 to contact an outer circumferential surface of the endlessly movable body; a nip-forming member 24 disposed at an interior side of the surface movable body and contacting the pressure member via the surface movable body, to thus form a nip portion; and a heat source such as a halogen heater 23 to heat the internal surface of the surface movable body by a radiant heat, wherein a recording medium such as a sheet P is conveyed through the nip portion to fuse an image onto the recording medium, the fixing device 100 further includes: a plurality of shielding members 29 disposed between the heat source and the surface movable member and movable between a shielding position where the shielding member shields the radiant heat from the heat source to a non-sheet passing area on the surface movable body and a retracted position which is retracted from the shielding position; and a controller to control operation of each shielding member.

In Aspect A, the controller controls each operation of the shielding member such that each position of the shielding member that is positioned at the shielding position and the shielding member, which is positioned at the retracted position, may be switched at a predetermined timing. With such control, the shielding member heated by the heat source at the shielding position before switching can be moved to the retracted position so as not to be heated by the heat source. As a result, that the shielding member positioned at the shielding position before switching is heated excessively beyond the heatproof temperature can be prevented. Thus, the present invention provides an optimal effect to prevent deformation of the shielding member due to an excess temperature rise.

<Aspect B> In the above Aspect A, a reflecting member 26 to reflect the radiant heat from the heat source is disposed between the heat source and the nip forming member, and a reflectivity of the surface of the shielding member opposite the heat source is lower than that of the surface of the reflecting member 26 opposite the heat source. With such a structure, a localized excessive temperature rise in the reflecting member 26 due to the reflection of heat from the shielding member 29 may be minimized.

<Aspect C> The above shielding member is formed of a highly thermally conductive material. With such a structure, a localized excessive temperature rise in the shielding member may be minimized.

<Aspect D> The shielding member includes a highly thermally conductive layer. With such a structure, a localized excessive temperature rise in the reflecting member 26 may be effectively minimized.

<Aspect E> The shielding members each include a different shielding area. With this aspect, compared to the case in which only one shielding member 29 is used to handle all sheet sizes, each moving range of the shielding member is made smaller, thereby enabling to make the apparatus compact.

<Aspect F> Moving direction of each shielding member is the same. With this aspect, each moving range of the shielding member is made smaller, thereby enabling to make the apparatus compact.

<Aspect G> Moving direction of each shielding member is different. With this aspect, each moving range of the shielding member is made smaller, thereby enabling to make the apparatus compact. In addition, an allowance to the interference with each shielding member can be improved.

<Aspect H> Each shielding member is configured to be movable independently. Thus, the control on the operation of each shielding member can be finely controlled.

<Aspect I> Each shielding member is configured to move in conjunction with each other by a linkage mechanism. With this aspect, the single drive source is used for controlling the shielding member, thereby enabling a low cost and space saving apparatus.

<Aspect J> An image forming apparatus including an image carrier, a toner image forming means to form a toner image on the image carrier, a transfer means to transfer the toner image from the image carrier to a recording medium, and a fusing means to fix the transferred toner image onto the recording sheet, in which the fixing device as defined in the above aspect A to I is used. With such a structure, while suppressing deformation of the shielding member due to the excessive temperature rise, an optimal image formation can be performed.

Additional modifications and variations of the present invention are possible in light of the above teachings. It is therefore to be understood that, within the scope of the appended claims, the invention may be practiced other than as specifically described herein.

What is claimed is:

1. A fixing device comprising:

an endless moving member;

a pressure member to contact an outer circumferential surface of the endless moving member;

a nip forming member disposed at an interior side of the moving member and contacting the moving member against the pressure member to form a nip portion;

a heat source disposed at an interior side of the moving member to heat the moving member with radiant heat, wherein a recording medium is conveyed through the nip portion to fix an image onto the recording medium;

plural shielding members disposed between the heat source and the moving member and movable along a circumference of the endless moving member between a shielding position where the plural shielding members shield a non-sheet passing area on the moving member from the radiant heat from the heat source and a retracted position; and a control circuit to move each of the plural shielding members between the shielding position and the retracted position.

2. The fixing device as claimed in claim 1, further comprising a reflecting member to reflect the radiant heat from the heat source, the reflecting member disposed between the heat source and the nip forming member, wherein a reflectivity of a surface of each of the plural shielding members opposite the heat source is lower than that of a surface of the reflecting member opposite the heat source.

3. The fixing device as claimed in claim 1, wherein each of the plural shielding members is formed of a material having high thermal conductivity.

4. The fixing device as claimed in claim 1, wherein each of the plural shielding members comprises a highly thermally conductive layer.

5. The fixing device as claimed in claim 1, wherein the plural shielding members shield different areas of the moving member.

6. The fixing device as claimed in claim 5, wherein the plural shielding members are configured to move in the same direction.

7. The fixing device as claimed in claim 5, wherein the plural shielding members are configured to move in different directions.

8. The fixing device as claimed in claim 1, wherein the plural shielding members are configured to move independently of each other.

9. The fixing device as claimed in claim 1, further comprising a linkage mechanism to move the plural shielding members cooperatively.

10. An image forming apparatus comprising:

an image carrier;

a toner image forming unit to form a toner image on the image carrier;

a transfer unit to transfer the toner image from the image carrier to a recording medium; and the fixing device as claimed in claim 1.

* * * * *